US008136896B2

(12) United States Patent
Woo et al.

(10) Patent No.: US 8,136,896 B2
(45) Date of Patent: Mar. 20, 2012

(54) LAUNDRY TREATING MACHINE

(75) Inventors: Ki Chul Woo, Seoul (KR); Na Eun Kim, Seoul (KR); Dong Won Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 833 days.

(21) Appl. No.: 12/122,044

(22) Filed: May 16, 2008

(65) Prior Publication Data

US 2009/0072684 A1 Mar. 19, 2009

(30) Foreign Application Priority Data

May 17, 2007 (KR) ..... 10-2007-0048044
May 17, 2007 (KR) ..... 10-2007-0048059
May 17, 2007 (KR) ..... 10-2007-0048060
May 17, 2007 (KR) ..... 10-2007-0048095
May 17, 2007 (KR) ..... 10-2007-0048098

(51) Int. Cl.
*A47B 77/06* (2006.01)

(52) U.S. Cl. ..... 312/228

(58) Field of Classification Search ..... 312/228; 248/188.1, 188.2, 188.4, 637, 676–678; 68/13 R
See application file for complete search history.

(56) References Cited

U.S. PATENT DOCUMENTS 4,002,199 A 1/1977 Jacobs
4,618,193 A * 10/1986 Cuthbert et al. ..... 312/228
5,228,499 A 7/1993 Yoon
5,368,379 A * 11/1994 Wrangberth ..... 312/228
5,392,615 A 2/1995 Lim
5,829,767 A * 11/1998 Grossman ..... 312/330.1
5,947,197 A 9/1999 Lee
6,158,257 A 12/2000 Ryan et al.
6,618,887 B2 9/2003 Kim et al.
6,732,552 B2 5/2004 Kim et al.
7,748,682 B2 * 7/2010 Hunke et al. ..... 248/678
7,976,111 B2 * 7/2011 Sans Rovira et al. ..... 312/228
2002/0017117 A1 2/2002 Sunshine et al.
2002/0056293 A1 5/2002 Kin et al.
2002/0153816 A1 10/2002 Banicevic et al.
2004/0134237 A1 7/2004 Sunshine et al.
2004/0226320 A1 11/2004 Bongini
2005/0150523 A1 7/2005 Schock
2005/0172678 A1 8/2005 Kim et al.

(Continued)

FOREIGN PATENT DOCUMENTS

CN 2256089 6/1997

(Continued)

OTHER PUBLICATIONS

International Search Report and Written Opinion of the International Searching Authority issued in PCT/KR2008/005686 dated Mar. 22, 2010.

(Continued)

*Primary Examiner* — Hanh V Tran
(74) *Attorney, Agent, or Firm* — KED & Associates LLP

(57) ABSTRACT

A laundry treating machine is provided which includes a cabinet that forms an external appearance of the laundry treating machine, a washing tub mounted in the cabinet, a housing mounted in the cabinet below the washing tub, the housing defining a predetermined space, and a movable body received in the housing such that the movable body can move in forward-and-rearward directions with respect to the cabinet.

31 Claims, 20 Drawing Sheets

U.S. PATENT DOCUMENTS

| | | | | |
|---|---|---|---|---|
| 2005/0178165 | A1 | 8/2005 | Carey et al. | |
| 2006/0103281 | A1 | 5/2006 | Cho | |
| 2006/0112737 | A1 | 6/2006 | Sunshine et al. | |
| 2006/0130518 | A1 | 6/2006 | Kang | |
| 2006/0130535 | A1 | 6/2006 | Sunshine et al. | |
| 2006/0156765 | A1 | 7/2006 | Sunshine et al. | |
| 2007/0075614 | A1 | 4/2007 | Calmeise | |
| 2007/0249212 | A1* | 10/2007 | Buecker et al. | 439/369 |
| 2009/0146536 | A1* | 6/2009 | Kim et al. | 312/228 |

FOREIGN PATENT DOCUMENTS

| | | |
|---|---|---|
| CN | 1542208 | 11/2004 |
| DE | 1 135 408 | 8/1962 |
| DE | 2034848 | 1/1972 |
| DE | 2703215 | 8/1978 |
| DE | 298 11 701 U1 | 11/1999 |
| DE | 19838631 | 3/2000 |
| DE | 19956973 | 8/2000 |
| DE | 203 02 572 | 5/2003 |
| DE | 10 2005 053 554 | 10/2006 |
| EP | 1 108 810 | 6/2001 |
| EP | 1 233 100 | 8/2002 |
| EP | 1 491 676 | 12/2004 |
| EP | 1 528 141 | 5/2005 |
| EP | 1 577 434 | 9/2005 |
| EP | 1 726 703 | 11/2006 |
| JP | 04-184077 | 7/1992 |
| JP | 2001-116421 | 4/2001 |
| JP | 2005-172298 | 6/2005 |
| JP | 2007-212053 | 8/2007 |
| WO | WO 2004/055254 | 7/2004 |

OTHER PUBLICATIONS

International Search Report and Written Opinion issued in Application No. PCT/KR2008/0027252 dated Aug. 5, 2010.

U.S. Office Action issued in U.S. Appl. No. 12/122,258 dated Jan. 21, 2011.

U.S. Office Action issued in U.S. Appl. No. 12/122,245 dated Feb. 23, 2011.

International Search Report and Written Opinion dated Aug. 16, 2010.

European Search Report dated Apr. 1, 2010.

International Search Report dated Nov. 3, 2010 (Application No. PCT/KR2008/002725).

European Search Report dated May 23, 2011. (Application No. 08753521.7-2314).

U.S. Office Action issued in U.S. Appl. No. 12/122,245 dated Jun. 30, 2011.

Chinese Office Action dated Aug. 22, 2011 (Application No. 200880024934.1).

U.S. Office Action issued in U.S. Appl. No. 12/252,973 dated Nov. 9, 2011.

* cited by examiner

LAUNDRY TREATING MACHINE

This application claims the benefit of Korean Patent Application Nos. 10-2007-0048095 filed on May 17, 2007, 10-2007-0048059 filed on May 17, 2007, 10-2007-0048060 filed on May 17, 2007, 10-2007-0048044 filed on May 17, 2007, 10-2007-0048098 filed on May 17, 2007, each of which is hereby incorporated by reference in its entirety as if fully set forth herein.

BACKGROUND

1. Field

A laundry treating machine is disclosed herein.

2. Background

Laundry treating machines are known. However, they suffer from various disadvantages.

BRIEF DESCRIPTION OF THE DRAWINGS

Embodiments will be described in detail with reference to the following drawings in which like reference numerals refer to like elements, and wherein.

DETAILED DESCRIPTION

Figure 1:
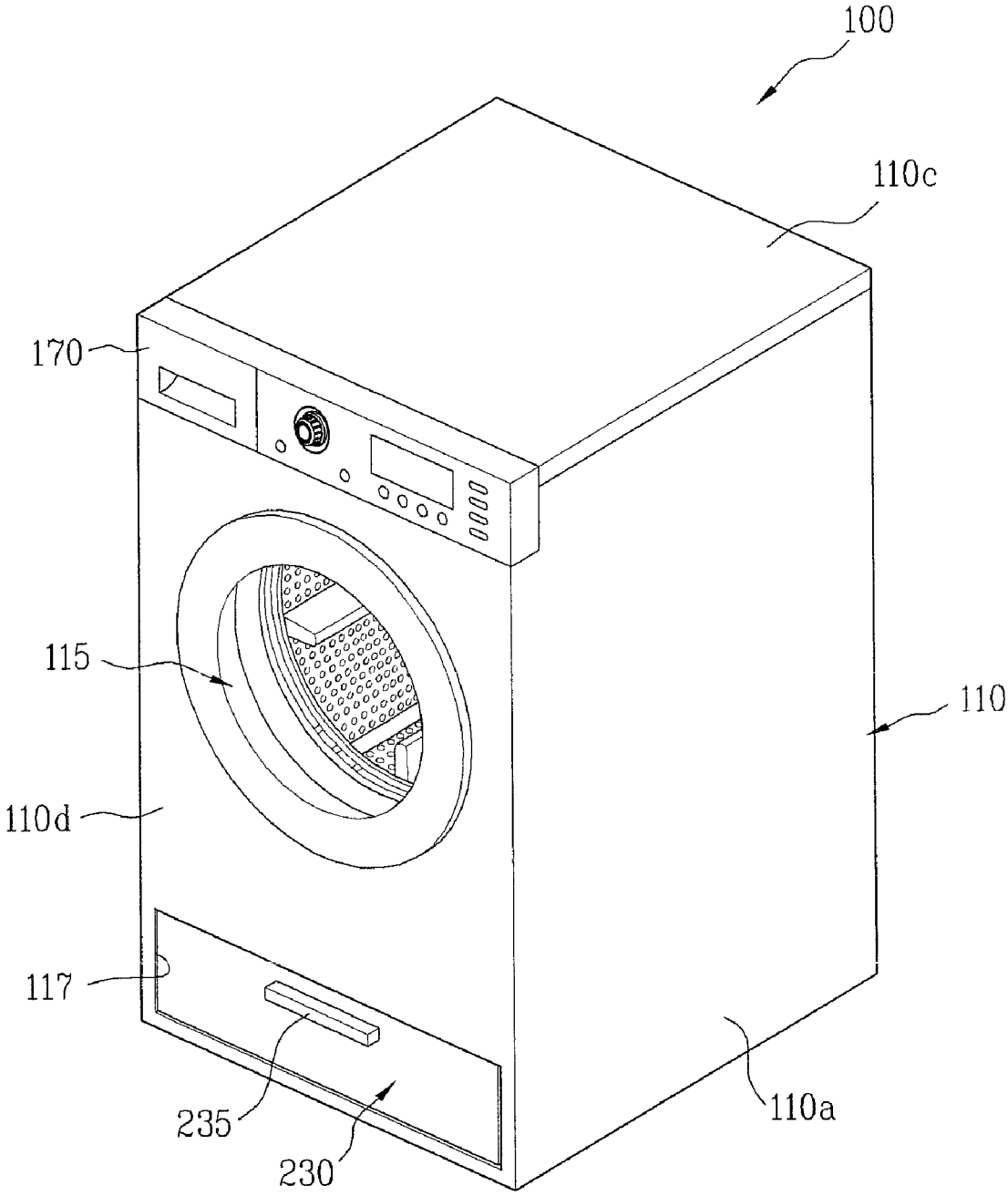
FIG. 1 is a front perspective view of a laundry treating machine according to an embodiment.

Reference will now be made in detail to embodiments, examples of which are illustrated in the accompanying drawings. Wherever possible, like reference numerals will be used throughout the drawings to refer to the same or like parts. Further, it should be understood that the various features of the various embodiments can be used with other embodiments to produce a laundry treating machine having desired features.

A washing machine, an example of a laundry treating machine or apparatus, performs washing, rinsing, and spin-drying processes to remove contaminants from laundry using interaction between detergent and water. Based on how the laundry is washed, the washing machine may be classified as a drum type washing machine, an agitator type washing machine, or a pulsator type washing machine.

The agitator type washing machine is a washing machine that washes laundry by rotating a wing-shaped agitator mounted at a bottom of a washing tub, the agitator extending uprightly from a center of the washing tub, in alternating directions. The pulsator type washing machine is a washing machine that washes laundry using a current of water generated by rotating a disk-shaped pulsator.

The drum type washing machine is a washing machine that supplies water, detergent, and laundry in a drum having a plurality of protruding members formed at an inside thereof and rotates the drum about a horizontal axis at a low speed to wash the laundry by an impact applied to the laundry, when the laundry is lifted and dropped by the protruding members, and a frictional force between laundry articles. The drum type washing machine has the advantages that damage to laundry is minimal and water consumption is low. In recent years, therefore, the drum type washing machine has been increasingly used.

Meanwhile, a drying machine is a kind of electric home appliance that dries wet laundry. In recent years, an electric home appliance having both a washing machine function and a drying machine function has been widely used. For convenience of description, the washing machine, the drying machine, and the electric home appliance having both the washing machine function and the drying machine function will be referred hereinafter as a laundry treating machine or apparatus.

Based on how laundry is loaded into the laundry treating machine, the laundry treating machine may be classified as a top loading type laundry treating machine or a front loading type laundry treating machine. Generally, the laundry treating machine is directly installed on a floor, such as a wooden floor, a cement floor, or a tile floor. However, the front loading type laundry treating machine has a problem in that the entrance of the front loading type laundry treating machine is low, and therefore, it is inconvenient for a user to load and unload laundry into and from the front loading type laundry treating machine.

Figure 2:
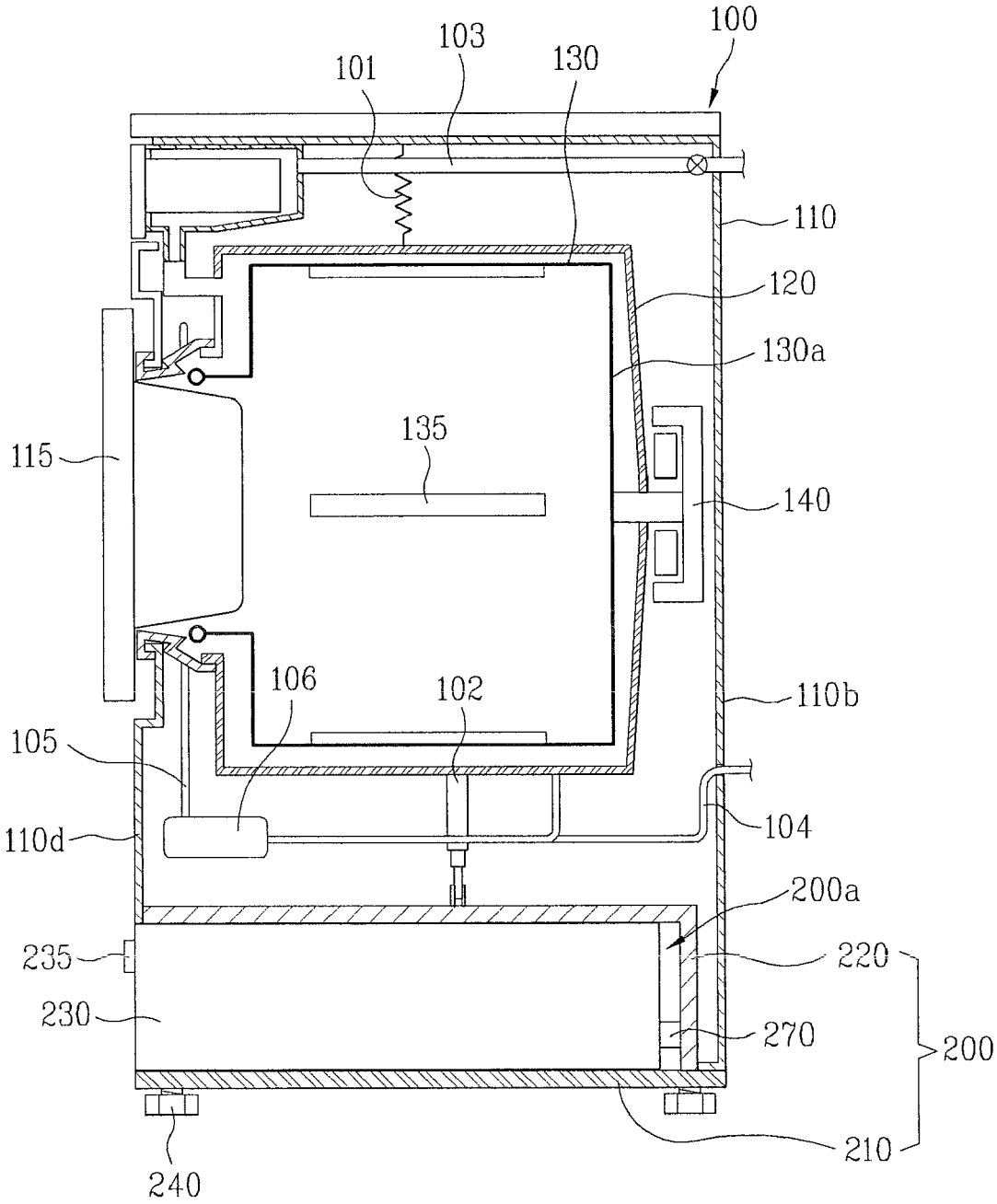
FIG. 2 is a side sectional view of the laundry treating machine of FIG. 1.

As shown in FIGS. 1 and 2, a laundry treating machine or apparatus 100 according to an embodiment may include a cabinet 110. The cabinet 110 may include a lower base 210 forming a bottom of the cabinet 110, side walls 110*a* forming opposite sides of the cabinet 110, a rear wall 110*b* forming a rear of the cabinet 110, a top wall or plate 110*c* forming a top of the cabinet 110, and a front wall or cover 110*d* forming a front of the cabinet 110.

A door 115 of the laundry treating machine 100 may be mounted at the front cover 110*d*. A control panel 170 that allows a user to manipulate the laundry treating machine 100 may be mounted on an upper front portion of the cabinet 110, as shown in FIG. 1.

A tub 120 may be mounted in the cabinet 110. The tub 120 may be supported by a spring 101 and a damper 102. A washing tub, i.e., drum 130, that receives laundry may be rotatably mounted in the tub 120. The drum 130 may be rotated by a motor 140 fixed to a rear wall 130*a* of the tub 120.

A plurality of lifts 135 may be mounted to an inside of the drum 130. The lifts 135 lift and drop laundry in the drum 130, during rotation of the washing tub, i.e., the drum 130, to apply a frictional force and an impact force to the laundry.

External water may be supplied into the tub 120 through a water supply hose 103 and stored therein. The water stored in the tub 120 may be drained to outside of the laundry treating machine 100 through a drainage hose 104. A circulation hose 105 may be connected to the tub 120. A circulation pump 106 may be mounted in a middle portion of the circulation hose 105. By operation of the circulation pump 106, water may be discharged out of the tub 120, and then sprayed into the tub 120 through the circulation hose 105.

The process of pumping water out of the tub 120 and then spraying the water into the tub 120 may be carried out forming various currents of water in the drum 130 and, at the same time, applying an impact force to laundry in the drum 130 and inducing friction between laundry articles, thereby improving a washing force and a rinsing force.

Between the washing tub, i.e., the drum 130, of the laundry treating machine 100 and an installation surface (i.e. a surface on which the laundry treating apparatus 100 is installed) of the laundry treating machine 100, a predetermined separation space may be provided, by which a position of the entrance of the laundry treating machine 100 may be raised, such that a user can easily load and unload laundry into and from the laundry treating machine 100. The separation space corresponds to a space provided between a washing tub of a conventional laundry treating machine and an installation surface of the conventional laundry treating machine, for example, when a height increasing member is installed below the conventional laundry treating machine.

Figure 3:
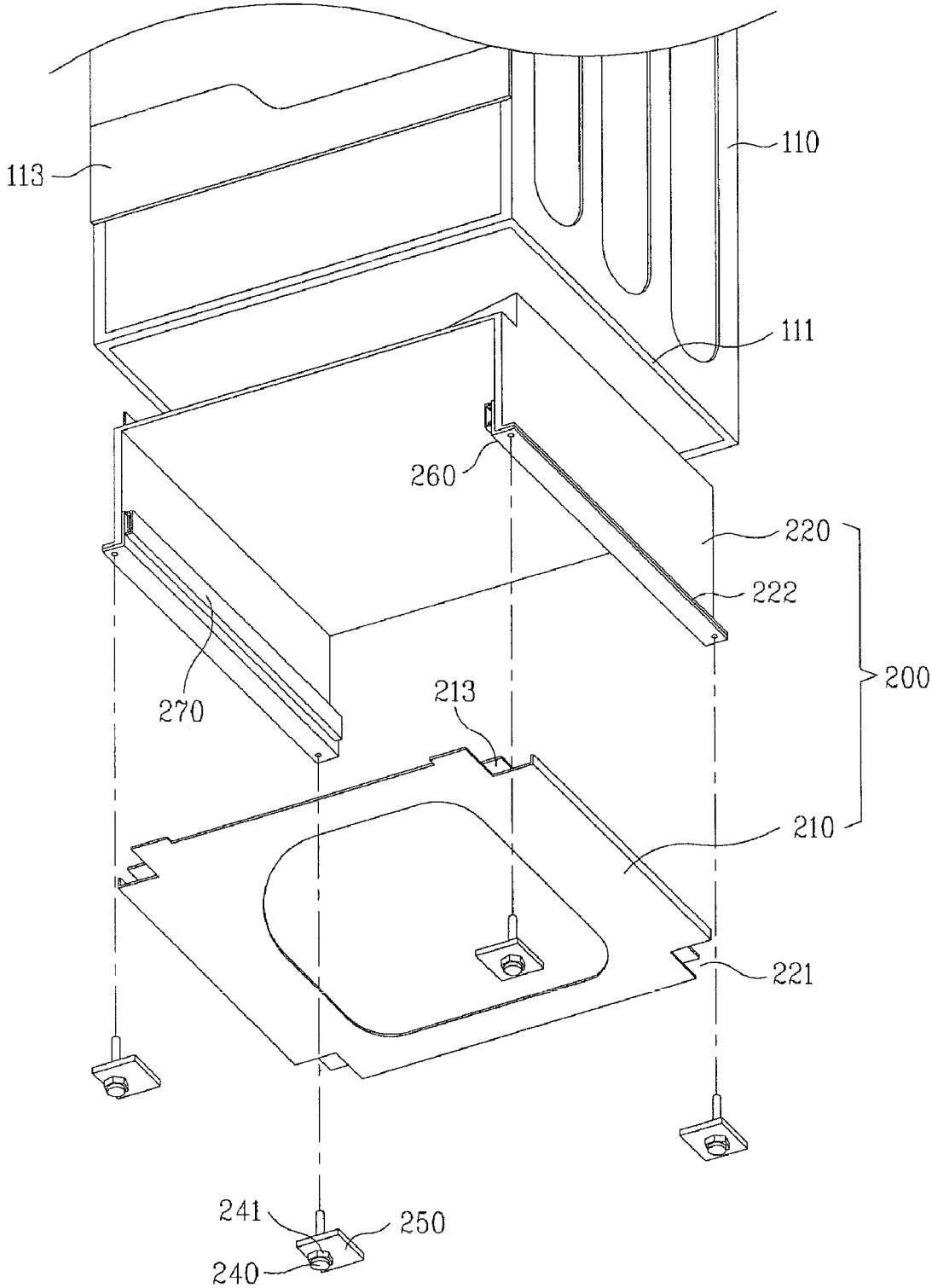
FIG. 3 is an exploded perspective view of a lower part of the laundry treating machine of FIG. 1.

The separation space between the washing tub, i.e., the drum 130, and the installation surface of the laundry treating machine may be provided by a housing 200. The housing 200 may include an upper base 220, as shown in FIG. 3, which may be mounted on the lower base 210, thereby forming a space between the drum 130 and the lower base 210. Consequently, the position of the entrance of the drum 130 may be raised by the height of the upper base 220, with the result that a user can load and unload laundry into and from the washing tub while not greatly bending his/her back during the use of the laundry treating machine 100, whereby a user's convenience is improved.

The damper 102, which supports the tub 120, may be connected to the upper base 220. Further, a plurality of reinforcing ribs that increase a strength of the upper base 220 may be formed on a top of the upper base 220, such that the damper 102 may be stably supported by the upper base 220. The damper 102 may be connected to a region of the upper base 220 where the strength of the upper base 220 is increased by the reinforcing ribs.

In embodiments disclosed herein, the upper base 220, serving as a height increasing member, may support only a weight of the tub 120 and components mounted on the tub 120, unlike a conventional height increasing member that supports a total weight of the laundry treating machine. In other words, the upper base 220 may not support a weight of the cabinet 110 and components mounted on the cabinet 110. Consequently, the upper base 220 according to embodiments disclosed herein may support a smaller weight than a conventional height increasing member. According to embodiments disclosed herein, therefore, it is possible to implement the upper base 220, serving as the height increasing member, in a lightweight structure at low cost using much less material than the conventional art.

A movable body 230 may be received in a space 200*a* provided between the upper base 220 and the lower base 210, as shown in FIG. 2. The movable body 230 may be received in the space such that it can be inserted into and withdrawn out of the cabinet 110. An opening that allows the movable body 230 to be inserted into and withdrawn out of the cabinet 110 therethrough may be formed in the front cover 110*d* of the cabinet 110.

The movable body 230 may include a grip 235. A user may pull the movable body 230 by holding the grip 235, to withdraw the movable body 230 out of the cabinet 110. Also, the user may push the movable body 230 to insert the movable body 230 into the space 200*a* defined between the upper base 220 and the lower base 210.

For smooth sliding movement of the movable body 230, as shown in FIGS. 3 to 6, one or more guide members 270 may be mounted to an inside surface of the upper base 220, such as an inside surface of side walls 220*a* of the upper base 220. Also, a plurality of housing reinforcing members 260 may be mounted inside the side walls 220*a* of the upper base 220 to increase a strength of regions where the one or more guide member 270 are mounted.

The movable body 230 may be implemented in various forms. A representative example of a movable body 230 is a drawer. When the movable body 230 is constructed in the form of the drawer, it is possible for a user to keep laundry goods or laundry as well as detergent and other laundry related items in the drawer, and therefore, a user's convenience is improved.

Alternatively, the movable body 230 may be constructed to include a small-sized electric home appliance. When a small-sized laundry machine, washing machine, or drying machine is employed as the movable body 230, a user may arrange a laundry machine, washing machine, or drying machine at an upper side, and the small sized laundry machine, washing machine, or drying machine, employed as the movable body 230, at a lower side. Of course, different types of small-sized electric home appliance, relevant or irrelevant to laundry treatment, may be implemented as the movable body 230.

The laundry treating machine 100 according to embodiments disclosed herein may further include a plurality of legs 240. The plurality of legs 240 may be coupled, for example, to the upper base 220 while avoiding the lower base 210. The assembly structure of the legs 240, the upper and lower bases 220 and 210, and the cabinet 110 is illustrated in FIGS. 3 to 6. Hereinafter, the assembly structure will be described in more detail with the related drawings.

Figure 4:
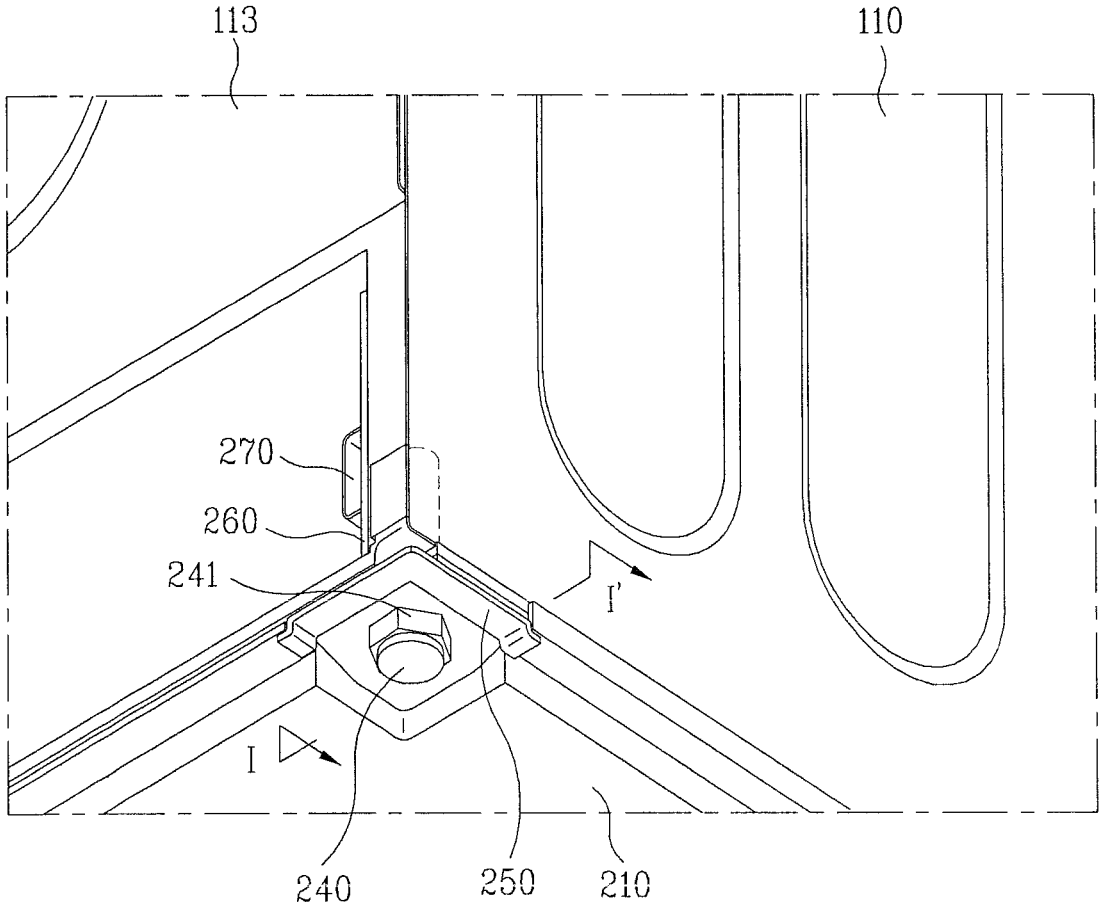
FIG. 4 is a partial perspective view of the lower part of the laundry treating machine of FIG. 1.
Figure 5:
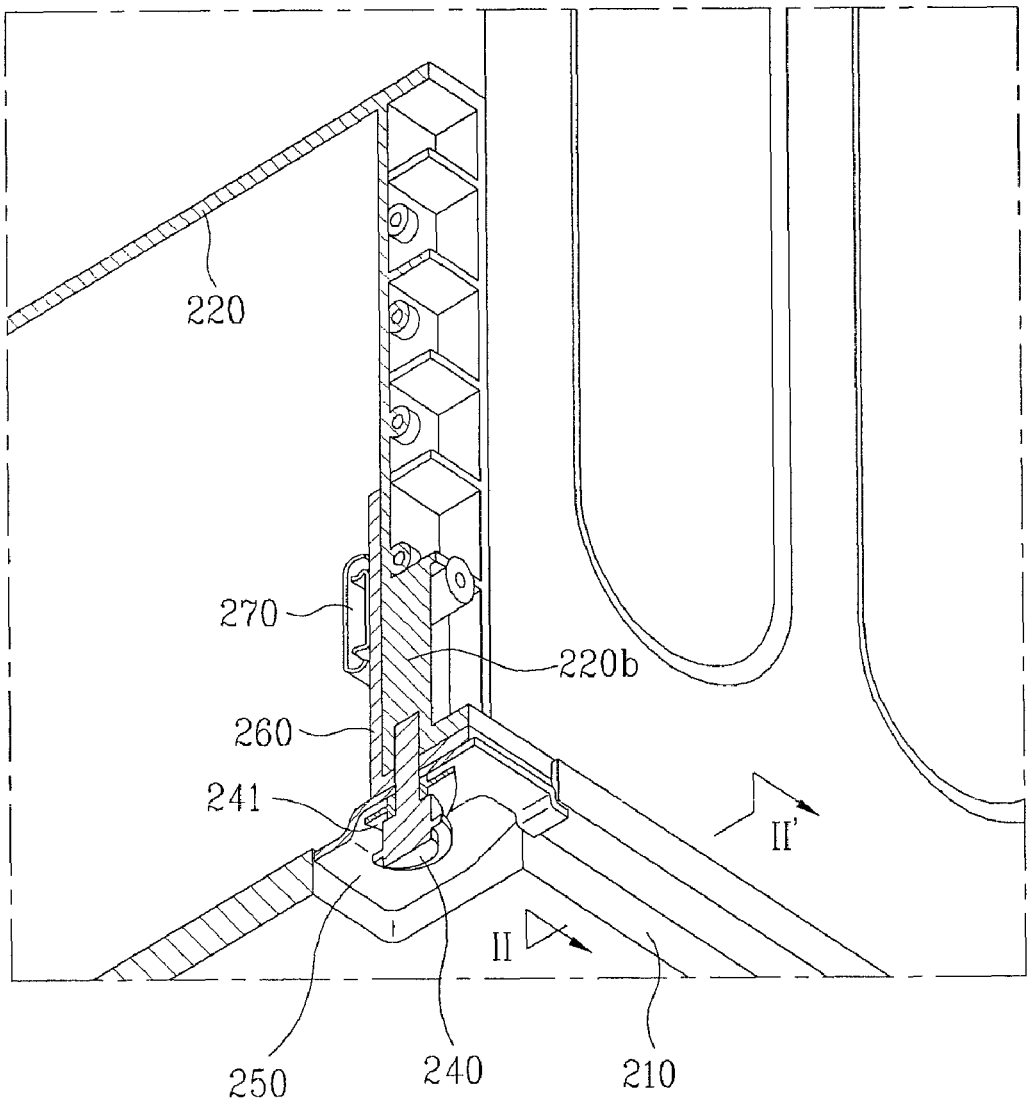
FIG. 5 is a sectional view taken along line I-I' of FIG. 4.
Figure 6:
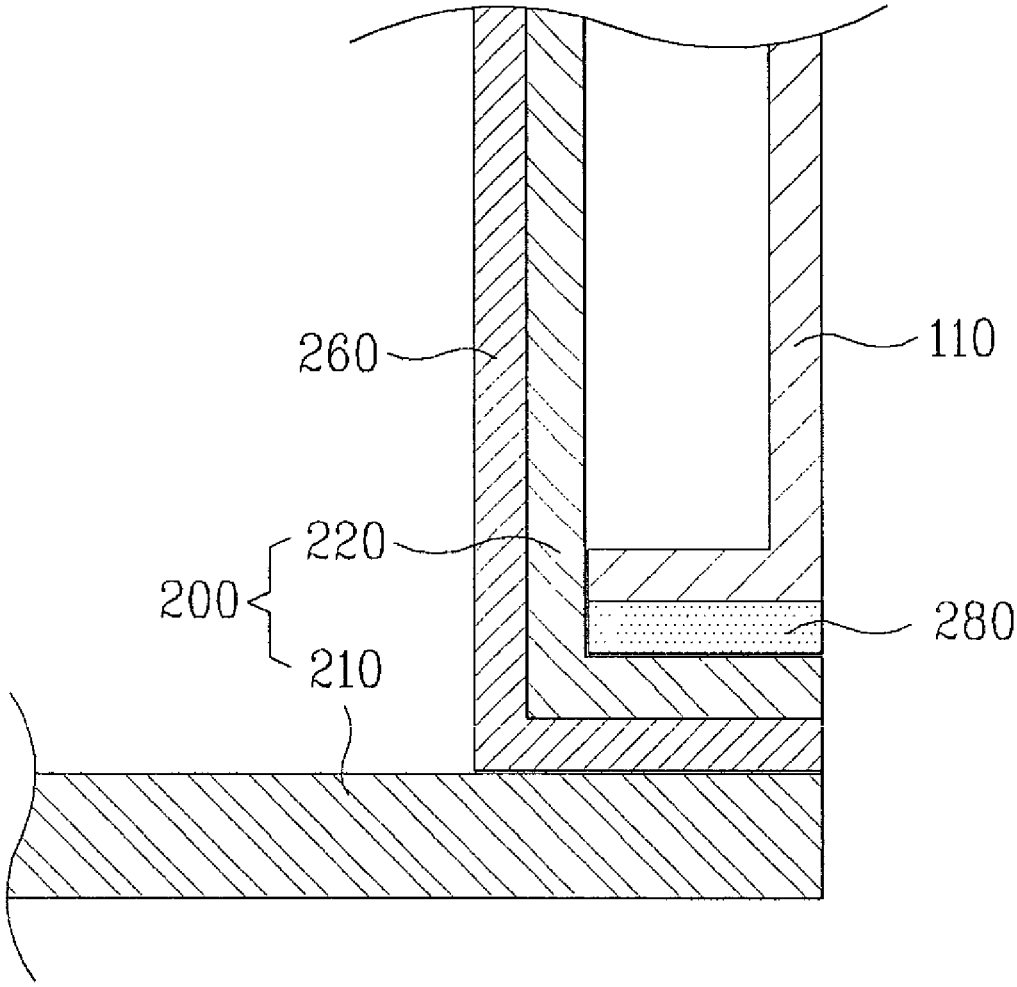
FIG. 6 is a sectional view taken along line II-II' of FIG. 5.

For reference, FIG. 3 is an exploded perspective view of a lower part of the laundry treating machine of FIG. 1. FIG. 4 is a partial perspective view of the lower part of the laundry treating machine of FIG. 1. FIG. 5 is a sectional view taken along line I-I' of FIG. 4, while FIG. 6 is a sectional view taken along line II-II' of FIG. 5.

As shown in FIG. 3, a first flange 111 may be formed at a lower part of the cabinet 110 such that the first flange 111 is bent inward as in the conventional art. The first flange 111 may be provided with a plurality of small-sized holes for, for example, screw or rivet coupling. A front reinforcing member 113 connecting two side walls of the cabinet 110 may be mounted at the front of the cabinet 110.

The top and the side walls of the upper base 220 may be received in the lower part of the cabinet 110. Second flanges 222 may be formed bent outward at lower ends of the side walls of the upper base 220. The lower base 210 may be disposed below the upper base 220. An edge of the lower base 210 may be fixed to the first flange 111 of the cabinet 110 by coupling members, such as screws or rivets. The second flanges 222 of the upper base 220 may be fixedly fitted between the first flange 111 of the cabinet 110 and an edge of the lower base 210, as shown in FIGS. 3 to 6.

As previously described, the housing reinforcing members 260 may be interposed between the lower base 210 and the second flanges 222 to increase the strength of the coupled structure. Here, the housing reinforcing members 260 may be formed in the shape of an "L," for example, such that the housing reinforcing members 260 may reinforce the side walls of the upper base 220 as well as coupling regions between the cabinet 110 and the upper and lower bases 220 and 210.

One or more anti-vibration members 280 to prevent transmission of vibration may be interposed between the first flange 111 and the second flanges 222, as shown in FIG. 6. As previously described, the damper 102, supporting the tub 120, may be connected to the upper base 220.

During operation of the laundry treating machine 100, vibration from the tub 120 may be transmitted to the upper base 220. The vibration from the tub 120 may be effectively prevented from being transmitted to the cabinet 110 and the lower base 210 by the anti-vibration members 280 interposed between the first flange 111 and the second flanges 222. As a result, it may be possible to reduce the generation of noise due to the vibration of the cabinet 110 and the lower base 210.

Cutout parts 211 may be formed on the lower base 210 to allow the legs 240 to be coupled to the upper base 220 while avoiding the lower base 210. As shown in FIG. 3, the cutout parts 211 may be formed at respective corners of the lower base 210 providing openings through which the legs 240 may pass.

Consequently, the legs 240 (in this embodiment screws 240*a* of the legs 240) may pass through the cutout parts 211 of the lower base 210, and may then be fixed to the side walls 220*a* of the upper base 220, as shown in FIG. 4. Structures, such as bosses 220*b*, to which the screws 240*a* of the respective legs 240 may be coupled may be provided at the side walls 220*a* of the upper base 220.

Since the legs 240 may be coupled to the upper base 220 while avoiding the lower base 210, vibration transmitted from the tub 120 to the upper base 220 may be effectively prevented from being transmitted to the lower base 210 and the cabinet 110. As a result, it may be possible to reduce the generation of noise due to the vibration of the cabinet 110, and the lower base 210.

At each cutout part 211 of the lower base 210, a step part 213 may be formed having a plane different from a bottom plane of the lower base 210, as shown in FIG. 3. Also, a bracket 250 may be disposed in each cutout part 211 such that the bracket 250 engages with the corresponding step part 213. The legs 240 may pass through the respective brackets 250, and then be coupled to the upper base 220. When fastening nuts 241 threadedly fitted on the respective legs 240 are fastened, the brackets 250 push the respective corners of the lower base 210 toward the cabinet 110.

Hereinafter, another embodiment in which a cabinet and a housing are coupled to each other will be described in detail with reference to FIG. 7.

The housing 200 includes an upper base 220 and a lower base 210. The housing 200 is coupled to the lower part of the cabinet 110. At the bottom of the cabinet 110 are mounted legs 240 for coupling the housing 200 to the cabinet 110.

As a result, the legs 240 serve as coupling members to couple the upper base 220 and the lower base 210 to the cabinet 110. Of course, the legs 240 may serve to wholly support the laundry treating machine 100 when the legs 240 are mounted at the bottom of the cabinet 110.

A first flange 111 may be formed at the lower part of the cabinet 110. The first flange 111 may be bent inwardly of the cabinet 119, as shown in FIG. 7. The first flange 111 may be provided with first coupling holes 111*a* for, for example, screw or rivet coupling.

Second flanges 222 may be formed at lower ends of the side walls 220*a* of the upper base 220, which may be bent outward. Each second flange 222 may be provided with second coupling holes 222*a* for, for example, screw or rivet coupling.

The lower base 210 may be disposed below the upper base 220. The lower base 210 may be provided with base holes 211 corresponding to the first coupling holes 111*a* and the second coupling holes 222*a*.

The legs 240 may pass through the base holes 211, the first coupling holes 111*a*, and the second coupling holes 222*a* to couple the lower base 210 and the upper base 220 to the cabinet 110. The second flanges 222 of the upper base 220 may be fixedly fitted between the first flange 111 of the cabinet 110 and the lower base 210.

Figure 7:
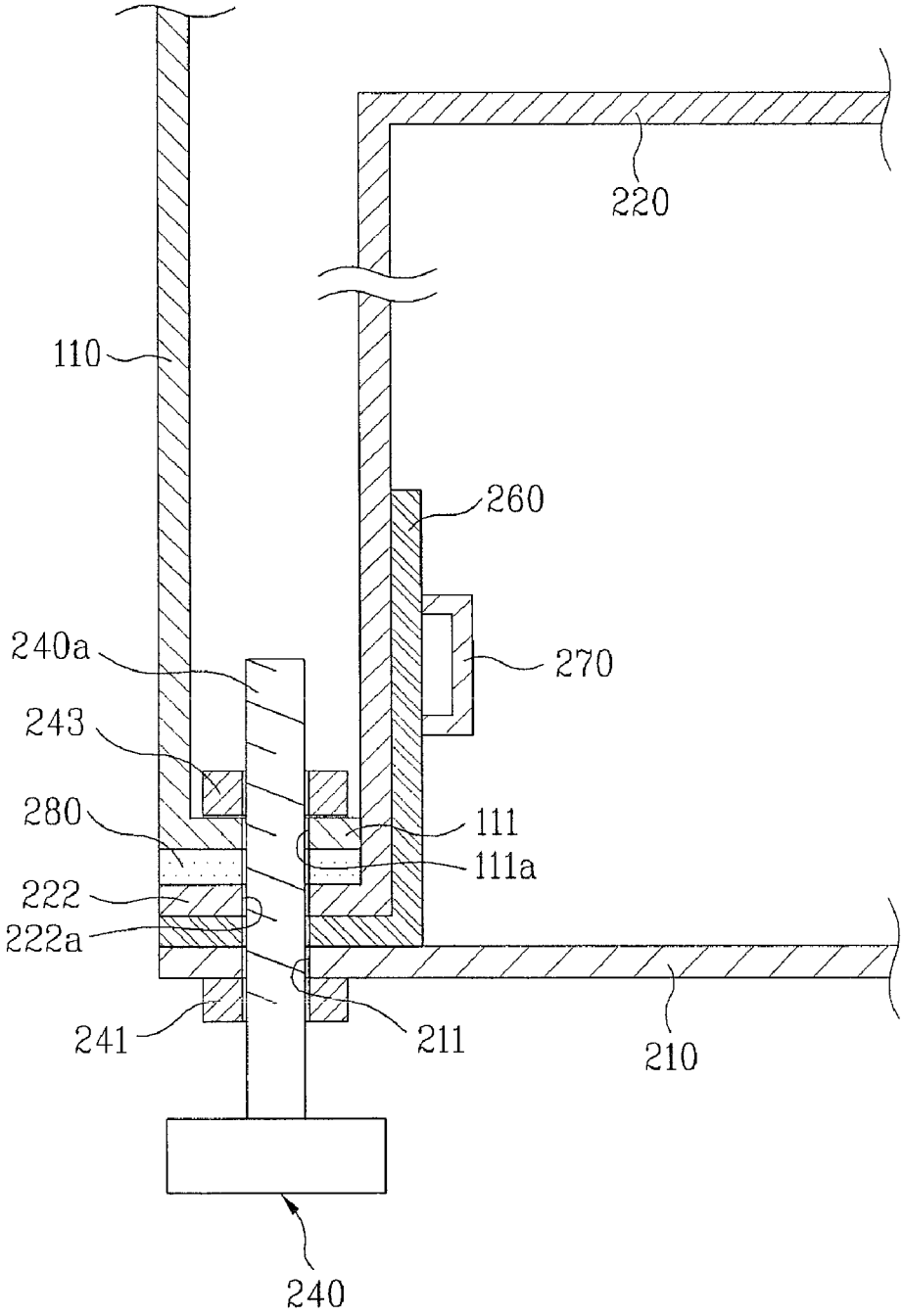
FIG. 7 is a sectional view illustrating principal components of a laundry treating machine according to another embodiment.

Fastening bolts 241 and 243 may be fastened outside the lower base 210 and the first flange 111 of the cabinet 110, respectively, as shown in FIG. 7. As a result, an edge of the lower base 210 and the second flanges 222 of the upper base 220 may be pushed toward the first flange 111 of the cabinet 110, whereby the coupling between the cabinet 110 and the housing 200 may be completed. In addition, installation of the legs 240 may also be completed.

Housing reinforcing members 260 may be interposed between the lower base 210 and the second flanges 222 to increase the strength of the housing 200. The housing reinforcing members 260 may be formed in the shape of "L," for example, such that the housing reinforcing members 260 may reinforce the side walls 220*a* of the upper base 220 as well as coupling regions between the cabinet 110 and the upper and lower bases 220 and 210.

Also, as shown in FIG. 6, anti-vibration members 280 may be interposed between the first flange 111 and the second flanges 222 to prevent transmission of vibration. During operation of the laundry treating machine 100, vibration from the tub 120 may be transmitted to the upper base 220. The vibration from the tub 120 may be effectively prevented from being transmitted to the cabinet 110 and the lower base 210 by the anti-vibration members 280 interposed between the first flange 111 and the second flange 222. As a result, it may be possible to reduce the generation of noise due to the vibration of the cabinet 110 and the lower base 210.

Also, the upper base 220 may be disposed in the cabinet 110 such that the side walls 110*a* of the cabinet 110 and the corresponding side walls 220*a* of the upper base 220 may be spaced a predetermined distance from each other. Consequently, the transmission of vibration between the cabinet 110 and the upper base 220 may be reduced by the space between the side walls 110*a* of the cabinet 110 and the corresponding side walls 220*a* of the upper base 220.

Figure 8:
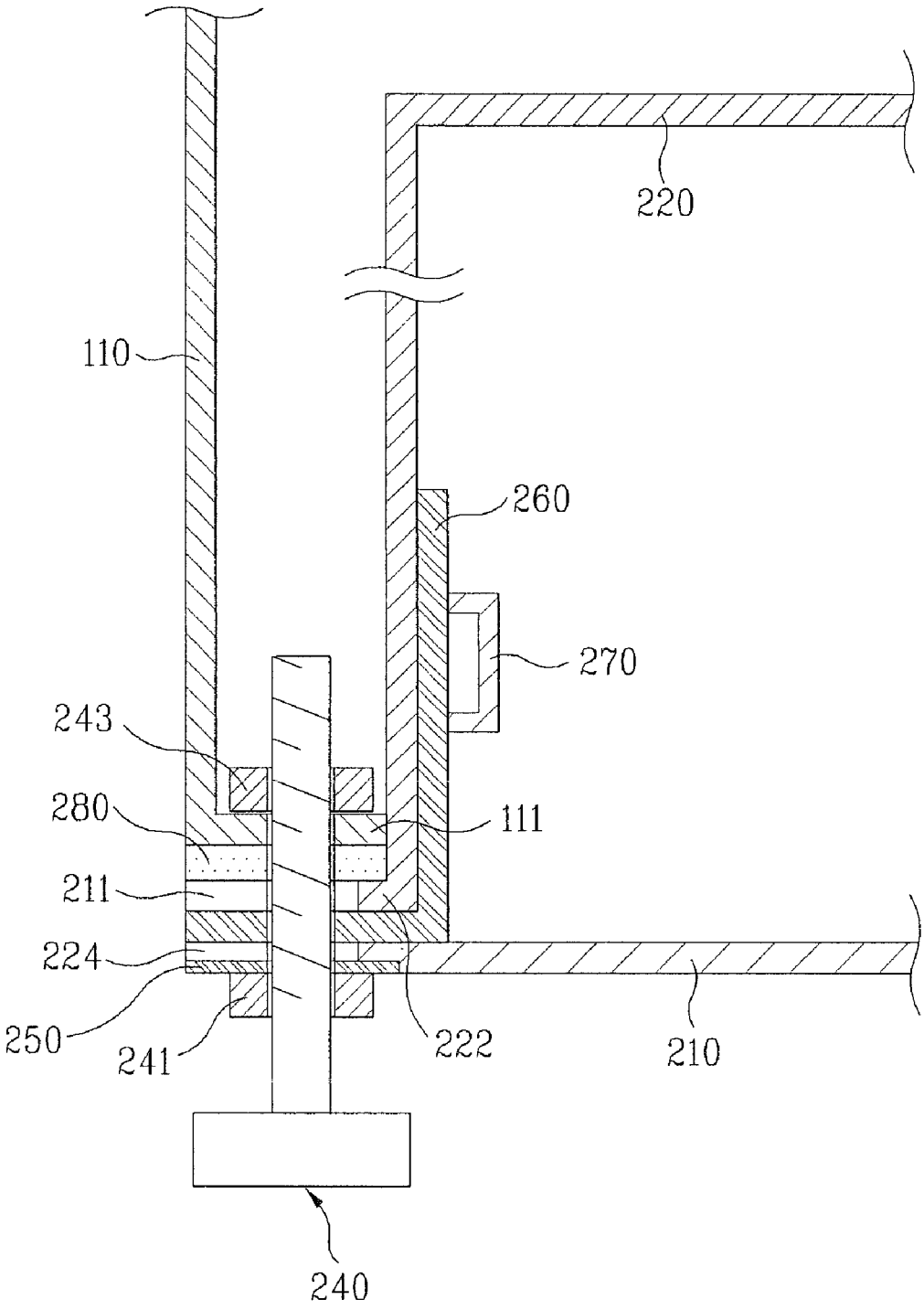
FIG. 8 is a sectional view illustrating principal components of a laundry treating machine according to another embodiment.

FIG. 8 shows an embodiment which is slightly different from the embodiment of FIG. 7, in the structure by which the legs 240 may be mounted to the laundry treating machine 100. In the embodiment of FIG. 8, the legs 240 may be fixed to the cabinet 110 while avoiding the housing 200.

In order to fix the legs 240 to the cabinet 110 while avoiding the housing 200, cutout parts 211 may be formed in the lower base 210, and cutout parts 224 may be formed in the second flanges 222 of the upper base 220. The cutout parts 211 and 224 may be formed at respective corners of the lower base 210 and the upper base 220 to provide spaces through which the legs 240 may pass. Consequently, the legs 240 (in this embodiment screws 240*a* of the leg 240) may pass through the cutout parts 211 and 224 of the lower base 210 and the upper base 220, and may then be fixed to the cabinet 110, as shown in FIG. 8.

When the legs 240 are coupled to the cabinet 110 while avoiding the housing 200, i.e., the upper base 220 and the lower base 210, vibration transmitted from the tub 120 to the upper base 220 may be effectively prevented from being transmitted to the cabinet 110. As a result, it is possible to reduce the generation of noise due to the vibration of the cabinet 110.

A step part having a plane different from the bottom of the base plane of the lower base 210 may be formed around each cutout part 211 of the lower base 210, as shown in FIG. 3. Also, a bracket 250 may be disposed at each cutout part 211 such that the bracket 250 engages with the corresponding step part.

The legs 240 may pass through the respective brackets 250, and then be coupled to the cabinet 110. When fastening nuts 241 threadedly fitted on the respective legs 240 are fastened, the brackets 250 push the respective corners of the housing 200, i.e., the upper base 220 and the lower base 210, toward the cabinet 110. As a result, the housing 200 may be stably fixed to the cabinet 110.

The housing 200 may receive the movable body 230 in a closed structure having a top or in an open structure having no top. When the housing 200 is provided with a top, installation positions of the tub and the movable body 230 may be partitioned from each other by the top of the housing 200.

Also, the damper 102 may be directly mounted to the top of the housing 200. Alternatively, the damper 102 may be supported by the side walls 110*a* of the cabinet 110.

Hereinafter, an embodiment in which the housing has a top so as to form a closed space and dampers are supported at the top of the housing 200 will be described with reference to FIGS. 9 to 11.

Figure 9:
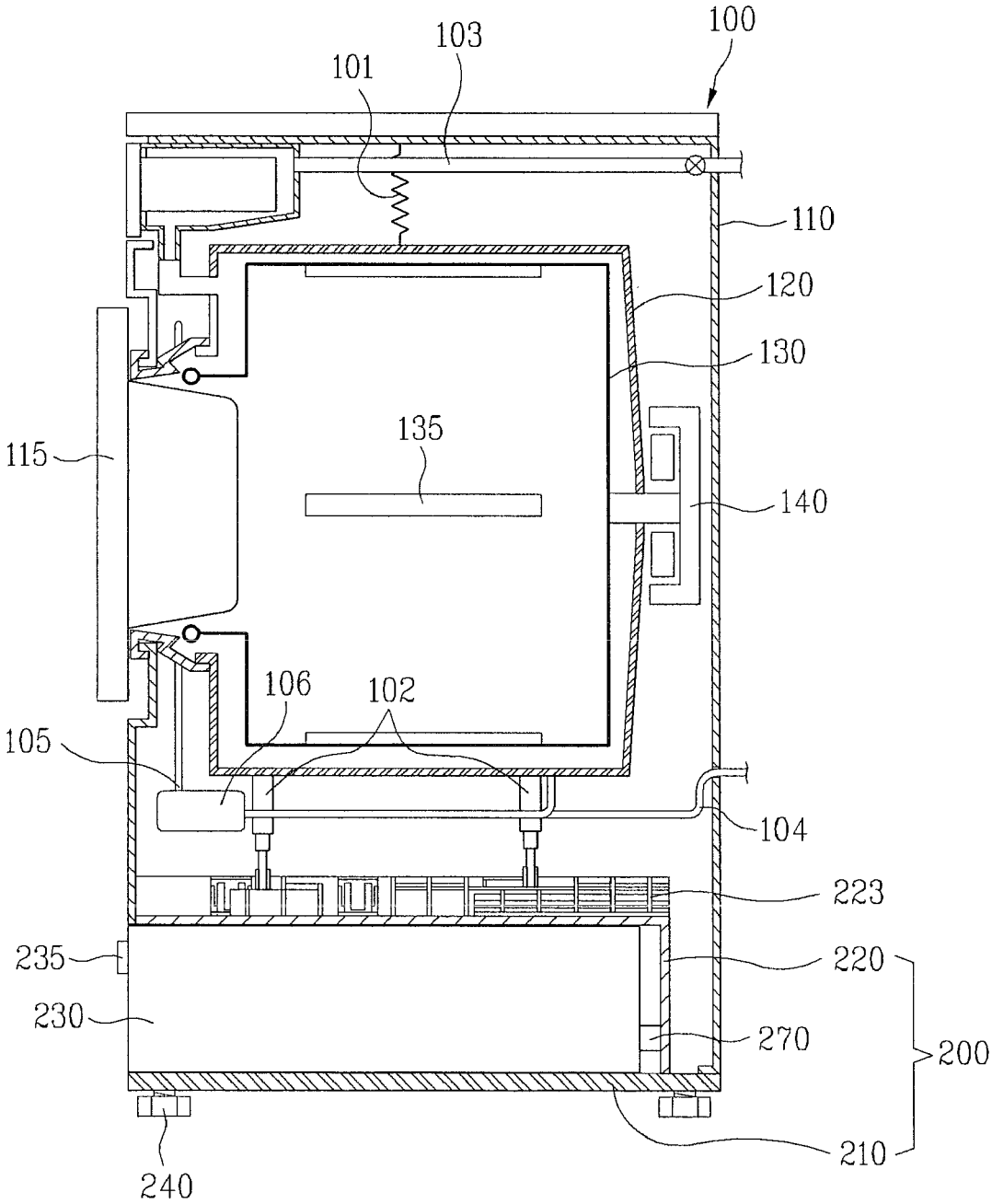
FIG. 9 is a sectional view of a laundry treating machine according to another embodiment.
Figure 10:
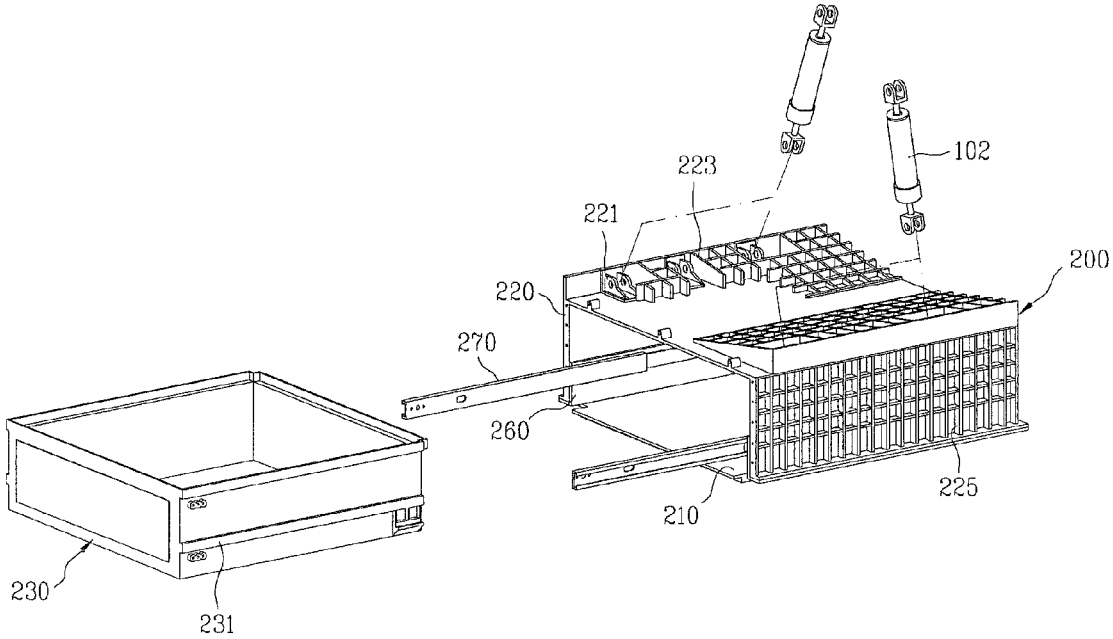
FIG. 10 is a front perspective view of a movable body and a housing of the laundry treating machine of FIG. 9.
Figure 11:
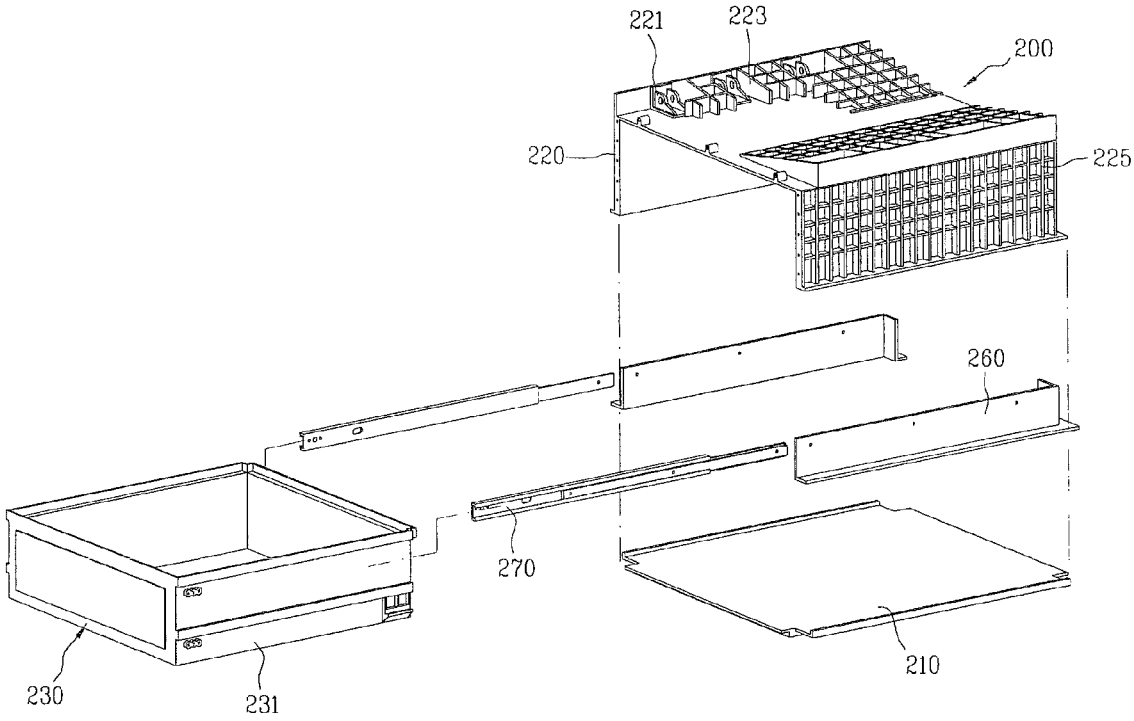
FIG. 11 is a front exploded perspective view of the movable body and the housing of the laundry treating machine of FIG. 9.

As shown in FIGS. 9 to 11, the housing 200 may include a lower base 210, that forms a bottom of the housing 200, and an upper base 220 mounted on the lower base 210 to define a receiving space 200*a* that receives the movable body 230 together with the lower base 210. The upper base 220 may increase a vertical distance between the drum 130 and the lower base 210 to raise a position of the opening of the drum 130, through which laundry may be loaded.

The upper base 220 may be disposed on the lower base 210 to secure a space between the drum 130 and the lower base 210. As a result, a separation space between the washing tub and the installation surface of the laundry treating machine may be provided.

Consequently, the position of the entrance of the washing tub, i.e., the drum 130, may be raised by a height of the upper base 220, with the result that a user can load and unload laundry into and from the washing tub while not significantly bending his/her back during the use of the laundry treating machine 100, whereby improving a user's convenience.

The lower base 210 may be mounted at the lower part of the cabinet 110 and may function as the bottom of the cabinet 110. Of course, the cabinet 110 may have a lower base forming the bottom of the cabinet 110, and the lower base 210 may be coupled to the lower base of the cabinet 110. Also, the housing may be integrally formed with the cabinet 110.

In addition, a plurality of reinforcing ribs 223 may be formed on the top of the housing 200, more specifically the upper base 220, to increase the strength of the housing 200. The reinforcing ribs 223 may protrude upward from the top of the upper base 220.

Damper coupling parts 221 to which dampers 102 may be coupled may be formed adjacent to the reinforcing ribs 223. A protruding length of the reinforcing ribs 223 may increase toward a region where the damper coupling parts 221 are formed. In other words, the protruding length of the reinforcing ribs 223 may increase toward opposite sides of the upper base 220 when viewed from a front of the housing 200.

The larger the protruding length of the reinforcing ribs 223, the greater a force to support the dampers 102. Consequently, when the dampers 102 are mounted in the regions where the protruding length of the reinforcing ribs 223 is relatively large, the dampers 102 may be effectively supported by the housing 200.

A plurality of side reinforcing ribs 225 may be formed at the side walls 220*a* of the upper base 220 to increase the strength of the housing 200. The side reinforcing ribs 225 may be uniformly distributed along the side walls 220*a* of the upper base 220.

Also, one or more guide members 270 may be mounted at inside surfaces of the upper base 220 to guide smooth sliding movement of the movable body 230. The movable body 230 may be provided at opposite sides thereof with one or more guide protrusions 231 corresponding to the one or more guide members 270. Consequently, when the movable body 230 slides in the housing 200, the one or more guide members 270 and the one or more guide protrusions 231 cooperate to guide the movement of the movable body 230.

Also, a plurality of housing reinforcing members 260 may be mounted inside the side walls 220*a* of the upper base 220 to increase the strength of regions where the one or more guide members 270 are mounted. The weight of the movable body 230 may be applied to the side walls 220*a* of the housing 200 via the one or more guide members 270. Consequently, the housing reinforcing members 260 may be mounted between the one or more guide members 270 and the side walls 220*a* of the housing to increase the strength of the side walls 220*a* of the housing 200.

Alternatively, the one or more guide members 270 may be disposed at lower parts of the side walls 220*a* of the housing 200 to minimize forces applied to the side walls 220*a* of the housing 200 due to the weight of the movable body 230. With this structure, a distance between a point to which the weight of the movable body 230 is applied and the support point of each side wall 220*a* of the housing 200 may be minimized, thereby minimizing the forces.

Figure 12:
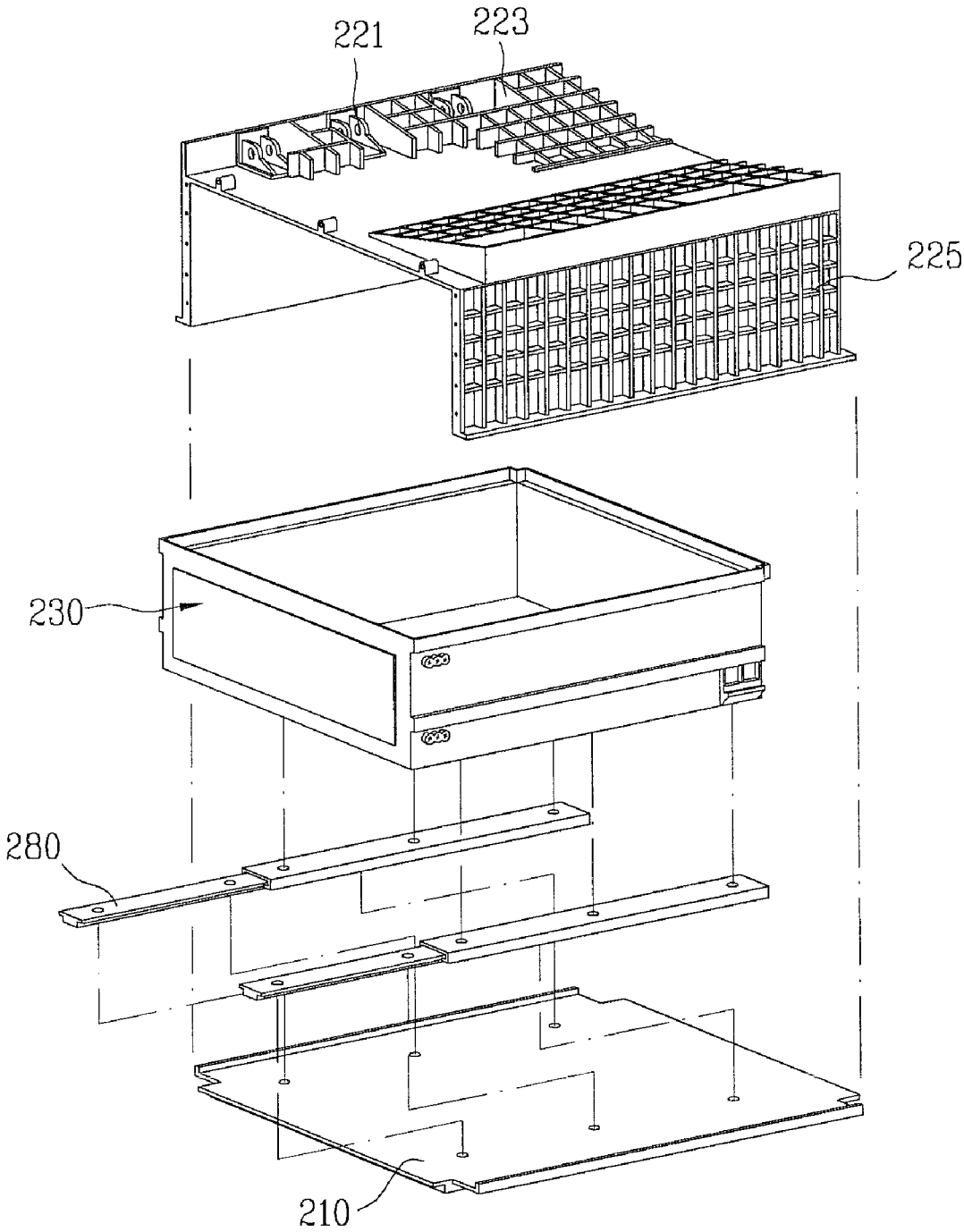
FIG. 12 is a front exploded perspective view of another embodiment of a housing.

Of course, the installation position of the one or more guide members 270 is not limit to the side walls 220*a* of the housing 200. For example, as shown in FIG. 12, the one or more guide members 270 may be mounted on a bottom of a housing 200.

Hereinafter, another embodiment of a housing of a laundry treating machine will be described in detail with reference to FIG. 13.

Figure 13:
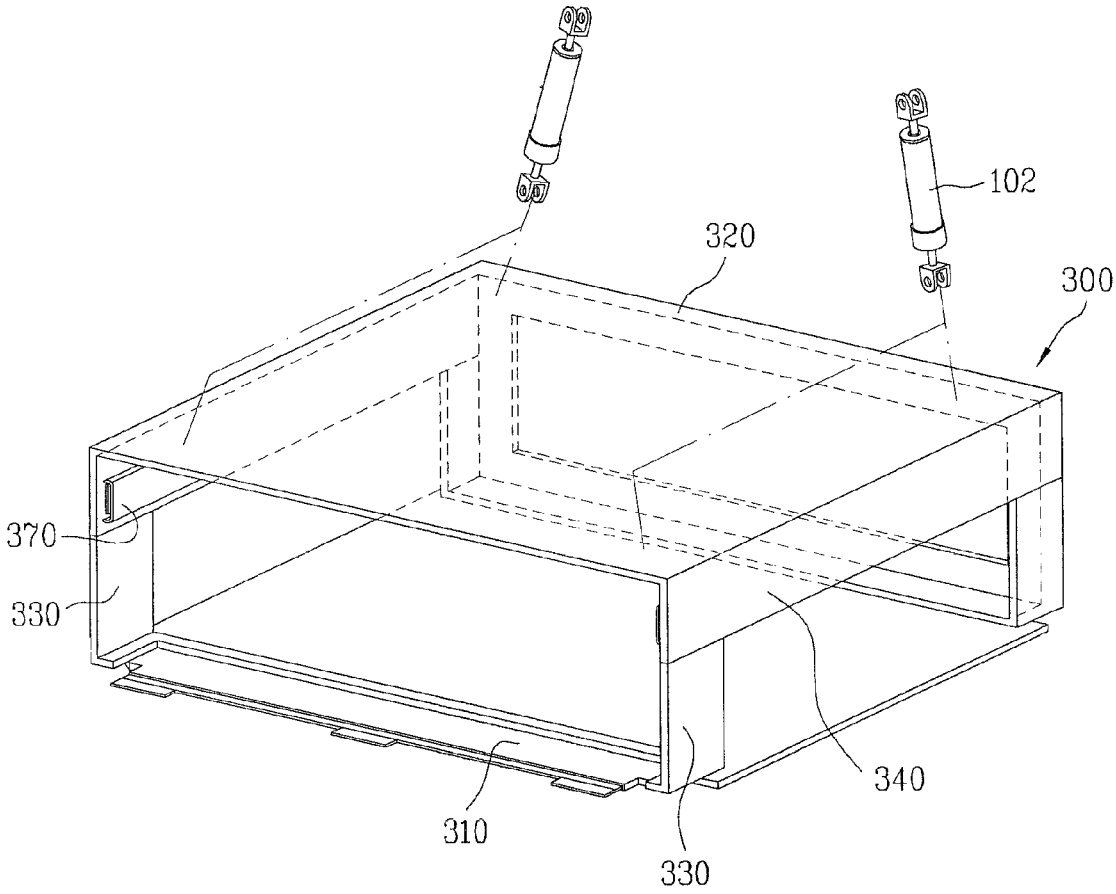
FIG. 13 is a front perspective view of another embodiment of a housing.

The housing 300 of FIG. 13 may include a lower panel 310 forming a bottom of the cabinet 110, side frames 330 mounted at side walls 110*a* of the cabinet 110, and an upper panel 320 mounted at upper ends of the side frames 330. The upper panel 320 and the lower panel 310 may be supported by the side frames 330. Further, the housing 300 may have open sides.

The side frames 330 may be coupled to the side walls 110*a* of the cabinet 110. Alternatively, the side frames 330 may be coupled to the lower panel 310 and the upper panel 320. Of course, the housing 300 may be integrally formed with the cabinet 110 of the laundry treating machine.

Dampers 102 may be mounted to a top of the upper panel 320 to support a washing tub of the laundry treating machine. Also, one or more guide members 370 may be mounted to inside surfaces of the side frames 330 to guide smooth sliding movement of the movable body 230.

The upper panel 320 may have bent panel parts 340 that interconnect the side frames 330 and increase the strength of the housing 300. The guide members 370 may be mounted to the respective bent panel parts 340. Of course, the bent panel parts 340 may be prepared separately from the upper panel 320. Even in this case, the side frames 330 may be connected to each other via the bent panel parts 340, and the guide members 370 may be mounted to the respective bent panel parts 340.

Figure 14:
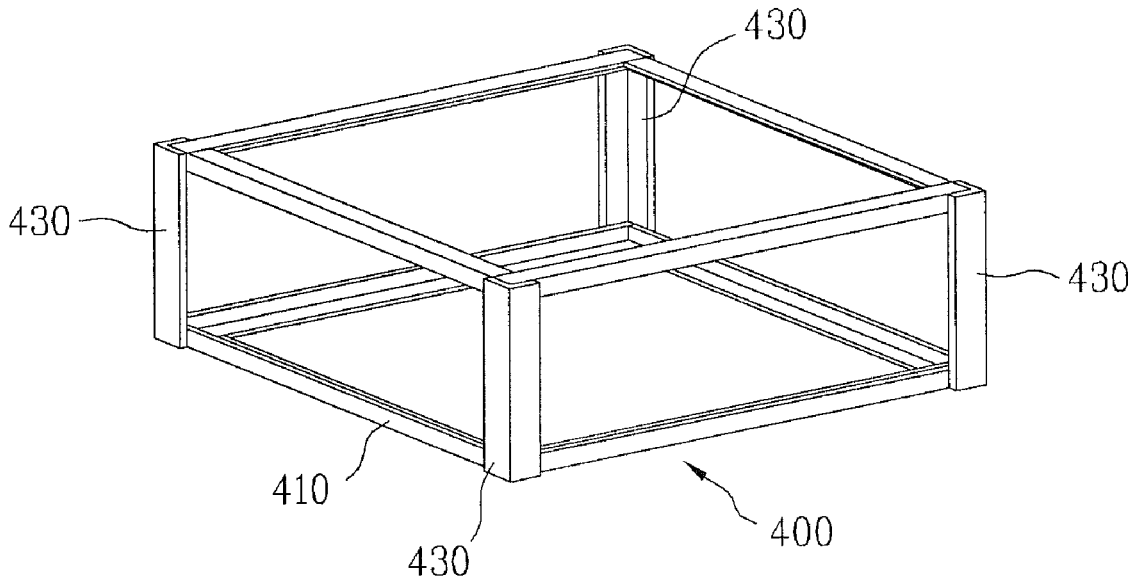
FIG. 14 is a front perspective view of a further embodiment of the housing.

In another embodiment shown in FIG. 14, a housing 400 is not provided with an upper panel. Rather, as shown in FIG. 14, the housing 400 may be constructed such that the housing 400 includes only a lower panel 410 and side frames 430 mounted to side walls 110*a* of the cabinet 110. In other words, the housing 400 may be constructed so as to have a frame structure in which one or more bar-shaped members 410 are coupled to one another.

Figure 15:
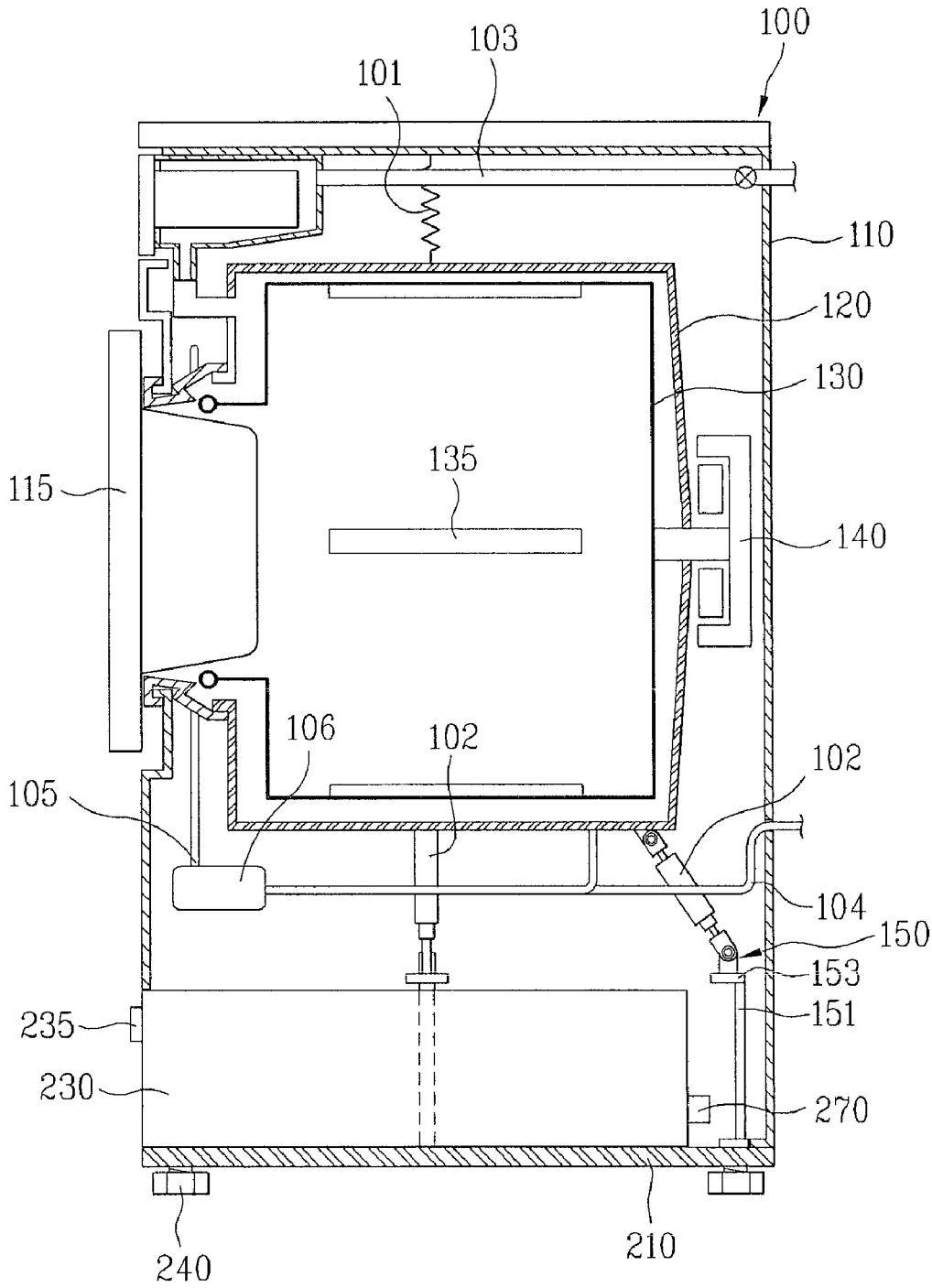
FIG. 15 is a sectional view of a laundry treating machine according to another embodiment.
Figure 16:
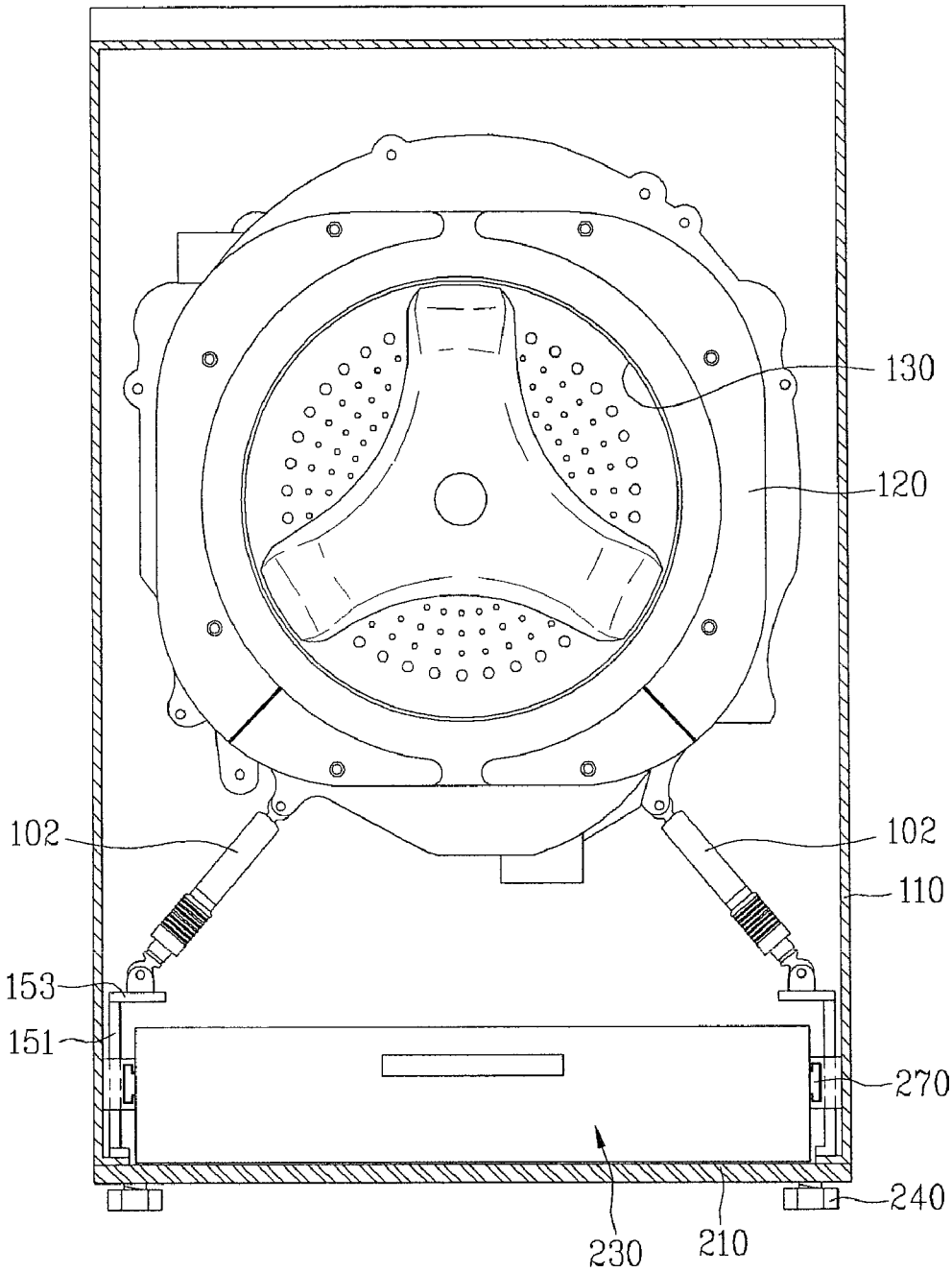
FIG. 16 is a sectional view illustrating principal components of the laundry treating machine of FIG. 15.

As shown in FIGS. 15 and 16, dampers 102 may be supported by damper supporting devices that extend from a lower wall or the side walls of the cabinet 110. That is, the dampers 102 may be supported by damper supporting devices 150 which are mounted at lower ends of the dampers 102. One end of each damper supporting device 150 may be coupled to a corresponding damper 102, and the other end of each damper supporting device 150 may be coupled to the lower base 210 or to the cabinet 110. Each damper supporting device 150 may include a damper bracket 153 directly coupled to the corresponding damper 102 and an extension member 151 that extends to a top surface of the lower base 210. When the damper supporting devices 150 are connected to the lower base 210, the damper supporting devices 150 may be at least partially located in the space in the housing 200 and the movable body 230 are received.

Figure 17:
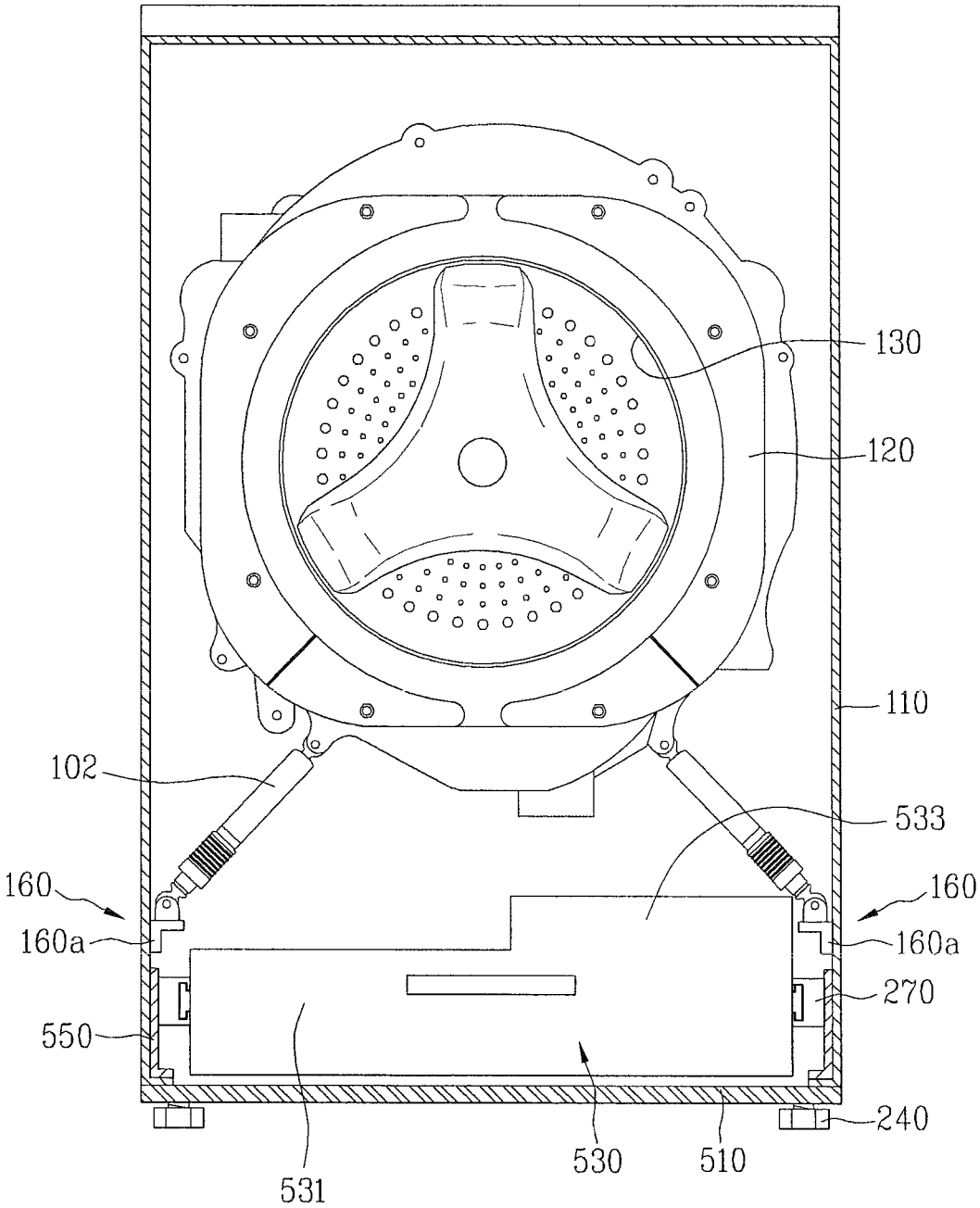
FIG. 17 is a sectional view illustrating principal components of a laundry treating machine according to another embodiment.

Also, as shown in FIG. 17, damper supporting devices 160 may extend from the side walls 110*a* of the cabinet 110. That is, each damper supporting device 160 may include a damper bracket 160*a* connected to the corresponding damper 102.

Also, a movable body 530 according to one embodiment may be formed in a shape corresponding to an inner space of the cabinet 110, that is, not in the shape of an ordinary drawer. For example, the movable body 530 may be constructed in a two-step structure. More specifically, the left-side part 531 and the right-side part 533 of the movable body 530 may have different heights.

The dampers 102 and the damper supporting devices 160 may be mounted at positions where the dampers 102 and the damper supporting devices 160 do not interfere with an installation space of the movable body 530. Consequently, it may be possible to efficiently use the inner space of the cabinet 110.

Also, one or more guide members 270 that guide movement of the movable body 530 may be mounted inside the cabinet 110. In addition, a plurality of housing reinforcing members 550 may be mounted inside the cabinet 110 to increase the strength of the cabinet 110, and, at the same time, to allow the one or more guide members 270 to be mounted thereto.

Figure 18:
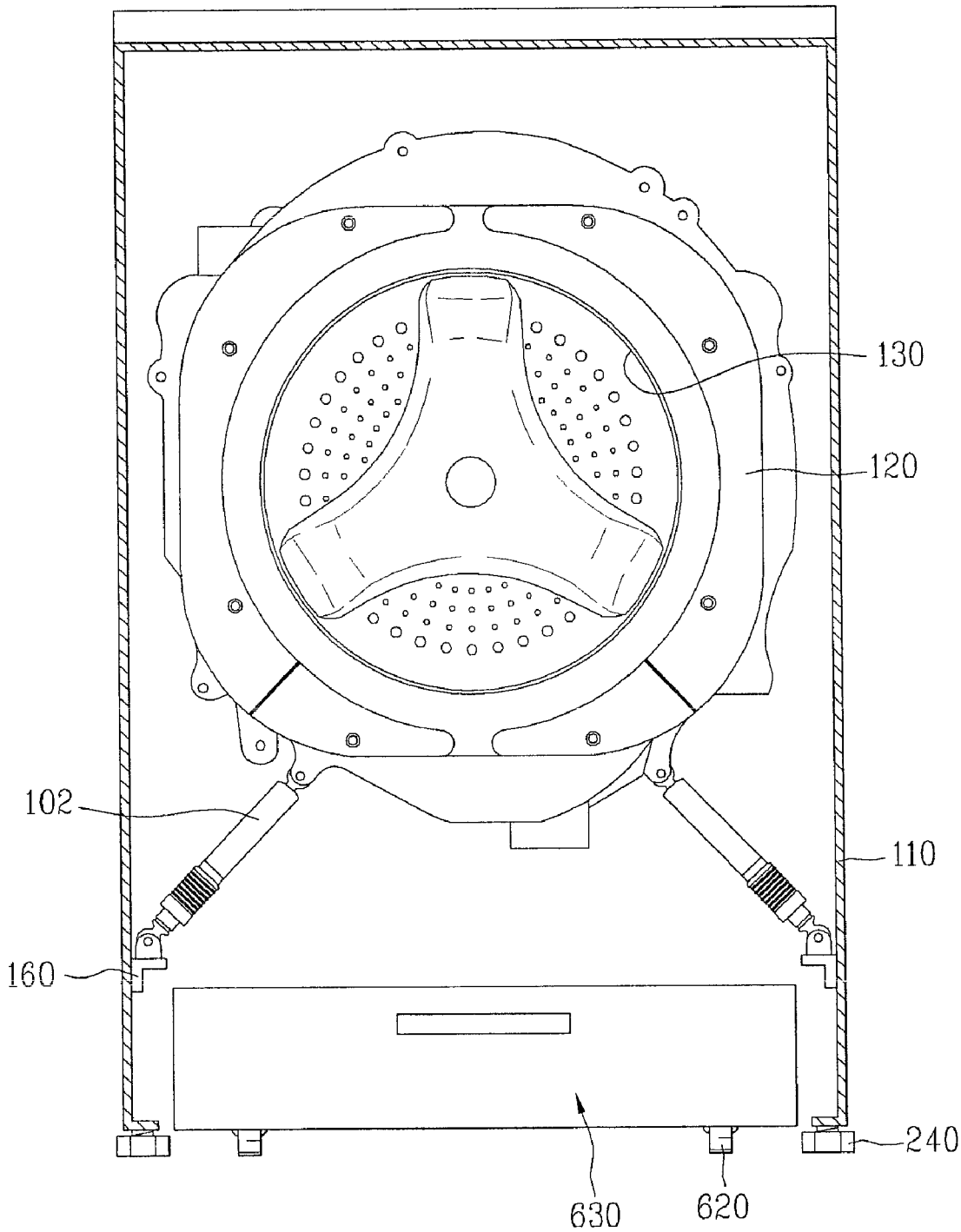
FIG. 18 is a sectional view illustrating principal components of a laundry treating machine according to another embodiment.

Hereinafter, another embodiment of a laundry treating machine will be described with reference to FIG. 18. Components of this embodiment that are identical to those of previous discussed embodiments are denoted by the same reference numerals, and a detailed description thereof is omitted.

Unlike the previous embodiments, with this embodiment an additional housing is not provided in the cabinet 110. In other words, only a space for receiving a movable body 630 is defined in the cabinet 110 without an additional housing.

A member forming the bottom of the cabinet 110 is not provided at the lower part of the cabinet 110. Rather, the cabinet 110 is constructed in a structure in which a bottom of the cabinet is open. That is, the cabinet 110 defines a space for receiving the movable body 630 in a state in which the bottom of the cabinet is open.

The movable body 630 slidably moves relative to the cabinet 110 such that the movable body 630 may be received in the cabinet 110. The movable body 630 may be provided at a bottom surface thereof with wheel members 620 that allow the movable body 630 to be moved. Further, the bottom surface of the movable body 630 may serve as the bottom of the cabinet 110.

Figure 19:
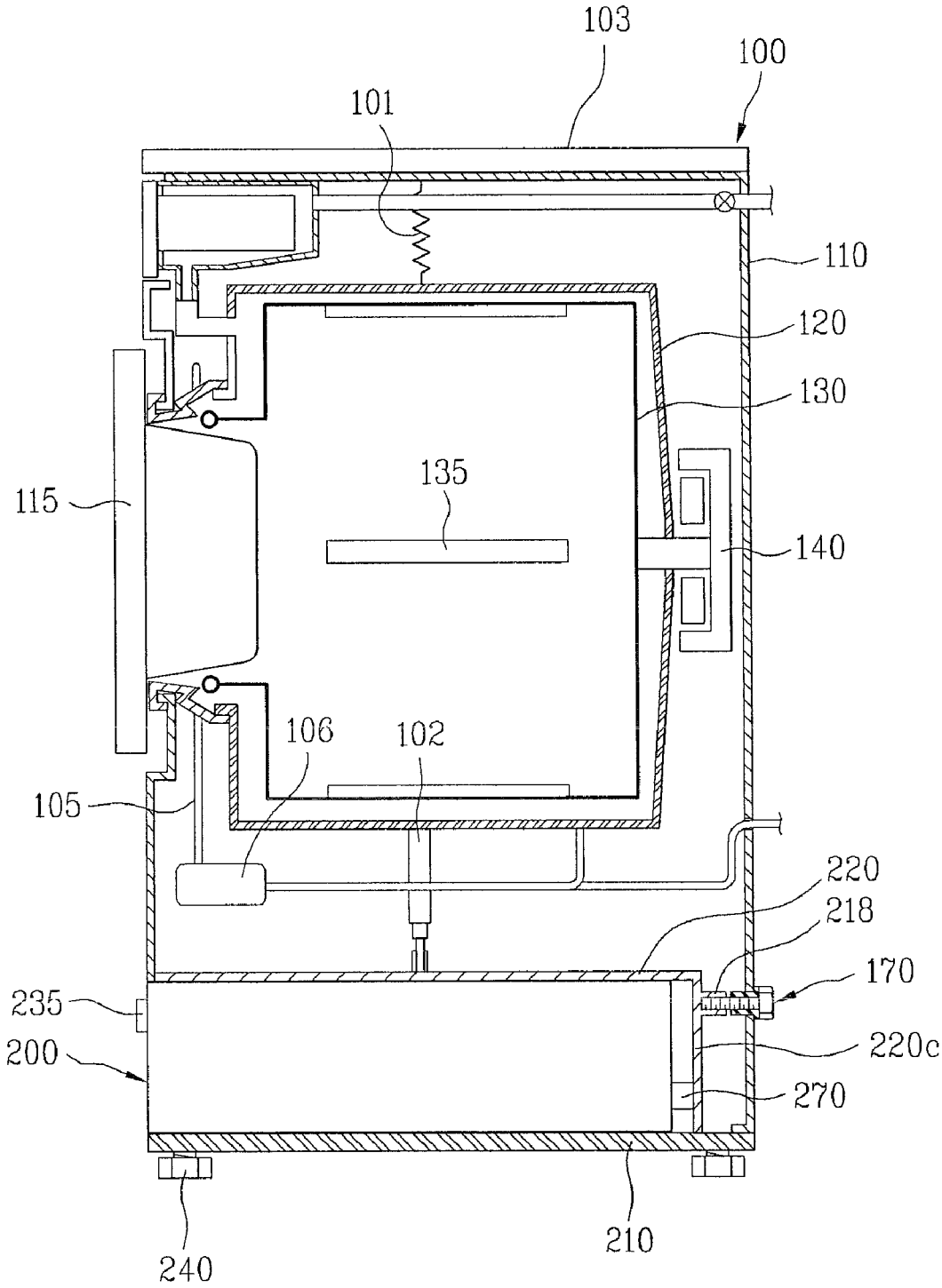
FIG. 19 is a sectional view illustrating a laundry treating machine according to another embodiment.
Figure 20:
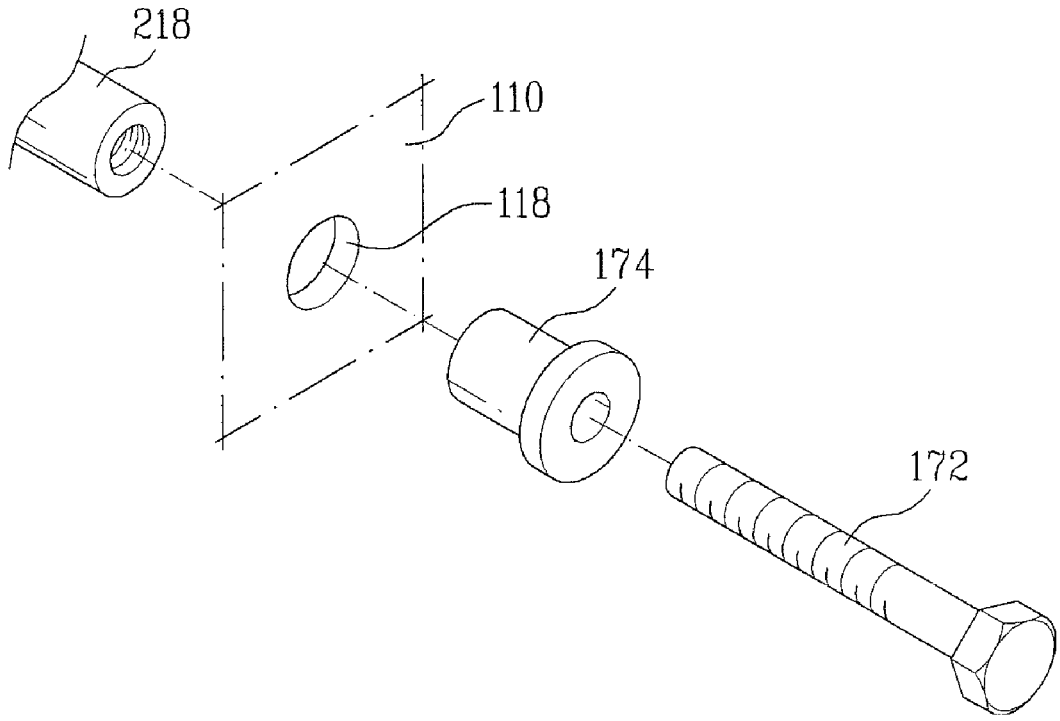
FIG. 20 is an exploded perspective view of a fixing device of the laundry treating machine of FIG. 19.

As shown in FIGS. 19 and 20, a laundry treating machine according to embodiments disclosed herein may further include a fixing device 170 that fixes a rear wall 220*c* of the housing 200 to the rear wall 110*b* of the cabinet 110. The fixing device 170 may include a hole 118 formed in the rear wall 110*b* of the cabinet 110, a boss 218 formed in the rear wall 220*c* of the housing 200, and a bolt 172 coupled to the boss 218 of the housing 200 through the hole 118 of the cabinet 110.

That is, the bolt 172 may be inserted through the hole 118 of the cabinet 110, and may then be coupled to the boss 218 formed in the rear wall 220*c* of the housing 200 to fix the housing to the cabinet 110. Meanwhile, when the bolt 172 is inserted through the hole 118 of the cabinet 110, and is then coupled to the boss 218 formed at the rear wall 220*c* of the housing 200, vibration may be transmitted between the housing 200 and the cabinet 110 via the bolt 172.

Also, when the housing 200 is made by injection molding, and the rear wall 110*b* of the cabinet 110 is made by press, manufacturing tolerance may occur. In this case, the hole 118 formed in the rear wall 110*b* of the cabinet 110 may not be correctly aligned with the boss 218 formed at the rear wall 220*c* of the housing 200. In order to solve the above-mentioned problems, therefore, an elastic member 174, made of a soft material, may be fitted in the hole 118 of the cabinet 110 in such a manner that the bolt 172 may be inserted through the elastic member 174. That is, the elastic member 174 may be disposed between the bolt 172 and the hole 118 of the cabinet 110.

As the elastic member 174 may be disposed between the bolt 172 and the hole 118 of the cabinet 110, the transmission of vibration through the bolt 172 may be reduced. Further, even when the hole 119 of the cabinet is not correctly aligned with the boss 218 of the housing, it may be possible to offset the manufacturing tolerance within a predetermined range, through deformation of the elastic member 174.

Embodiments disclosed herein are directed to a laundry treating machine that substantially obviates one or more problems due to limitations and disadvantages of the related art. Further, embodiments disclosed herein provide a laundry treating machine that is capable of allowing a user to easily load and unload laundry thereinto and therefrom. Furthermore, embodiments disclosed herein provide a laundry treating machine with improved inner spatial efficiency.

A laundry treating machine according to one embodiment disclosed herein includes a cabinet constituting an external appearance of the laundry treating machine, a washing tub mounted in the cabinet, a housing mounted in the cabinet below the washing tub, the housing defining a predetermined space, and a movable body received in the housing such that the movable body can move in the forward-and-rearward direction of the cabinet. The housing may include a lower base and an upper base disposed on the lower base for defining a space to receive the movable body between the upper base and the lower base. The laundry treating machine may further include legs coupled to the upper base while avoiding the lower base.

The cabinet may be constructed in a structure in which a lower end of the cabinet is coupled to the housing, and anti-vibration members may be mounted between the cabinet and the housing. The laundry treating machine may further include a plurality of legs coupled to the cabinet, while avoiding the housing, for supporting the cabinet. The housing and the cabinet may be arranged such that sides of the housing are spaced apart from the cabinet to reduce the transmission of vibration between housing and the cabinet. The lower base may constitute a bottom of the cabinet.

The laundry treating machine may further includes flanges extending from the cabinet, the lower base, and/or the upper base for coupling the lower base and the upper base to the cabinet, and legs corresponding to coupling holes formed at the flanges. The laundry treating machine may further include a damper supporting unit, one side of which is coupled to a damper for supporting the washing tub and the other side which is coupled to the housing or the cabinet.

The damper supporting unit may include a damper bracket connected to the damper and an extension member coupled to a lower base. Further, the damper supporting unit may be at least partially located between a side cover of the cabinet and the housing. Furthermore, the damper supporting unit may be supported at the top of the housing.

The laundry treating machine may further include reinforcing ribs protruding from a top of the housing for increasing the strength of the top of the housing. The housing may be constructed in a frame structure in which one or more bars are coupled to one another to define a space for receiving the movable body.

The laundry treating machine may further include a front reinforcing member for increasing the strength of a front cover of the cabinet. The laundry treating machine may also include a guide member for guiding the movement of the movable body.

The laundry treating machine may further includes a housing reinforcing member mounted inside the cabinet for increasing the strength of the cabinet and, at the same time, for allowing the guide member to be mounted thereto. Additionally, the laundry treating machine may include wheel members mounted at the bottom of the movable body for moving the movable body.

The laundry treating machine also includes a fixing unit inserted through a rear of the cabinet for fixing a rear of the housing. The fixing unit may include a bolt inserted through the rear of the cabinet such that the bolt is coupled to the rear of the housing and an elastic member disposed between an outer circumference of the bolt and the cabinet.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A laundry treating machine, comprising:

a cabinet forming an external appearance of the laundry treating machine;

a washing tub mounted in the cabinet;

a housing provided in the cabinet below the washing tub, the housing comprising a lower base and an upper base disposed on the lower base to define a predetermined space;

a movable body received in the housing such that the movable body is movable with respect to the cabinet; and a plurality of legs coupled to the upper base, wherein the lower base includes a plurality of cutouts through which the plurality of legs passes, respectively.

2. The laundry treating machine of claim 1, wherein the upper base is provided with a plurality of bosses configured to receive the plurality of legs, respectively.

3. The laundry treating machine of claim 1, wherein the plurality of cutouts is formed at respective corners of the lower base.

4. The laundry treating machine of claim 3, wherein each of the plurality of cutouts includes a stepped portion.

5. The laundry treating machine of claim 4, further comprising a plurality of brackets corresponding to the plurality of cutouts, respectively, wherein a respective leg passes through a respective bracket to couple the lower base to flanges of the upper base and the cabinet.

6. The laundry treating machine of claim 5, further comprising a plurality of housing reinforcing members, wherein a flange of each housing reinforcing member is interposed between a respective bracket and a corresponding upper base flange.

7. The laundry treating machine of claim 1, wherein a lower end of the cabinet is coupled to the housing.

8. The laundry treating machine of claim 7, further comprising a plurality of anti-vibration members mounted between the cabinet and the housing.

9. The laundry treating machine of claim 1, wherein the housing and the cabinet are arranged such that sides of the housing are spaced apart from the cabinet, thereby reducing transmission of vibration between the housing and the cabinet.

10. The laundry treating machine of claim 1, wherein the lower base forms a bottom of the cabinet.

11. The laundry treating machine of claim 1, further comprising:

a plurality of flanges that extends from the cabinet, the lower base, and the upper base that couple the lower base and the upper base to the cabinet.

12. The laundry treating machine of claim 11, wherein the plurality of legs corresponds to a plurality of coupling holes formed in the plurality of flanges.

13. The laundry treating machine of claim 11, further comprising a plurality of anti-vibration members disposed between the plurality of flanges of the cabinet and upper base.

14. The laundry treating machine of claim 1, further comprising:

one or more damper supporting devices, one side of each of which is coupled to a respective damper that supports the washing tub and the other side of each of which is coupled to one of the housing or the cabinet, respectively.

15. The laundry treating machine of claim 14, wherein the one or more damper supporting devices each comprises:

a damper bracket connected to the respective damper and one of a top of the housing and a sidewall of the cabinet.

16. The laundry treating machine of claim 14, wherein the one or more damper supporting devices each comprises:

a damper bracket connected to the respective damper; and an extension member coupled to a lower base of the housing.

17. The laundry treating machine of claim 14, wherein the one or more damper supporting devices is at least partially located between a sidewall of the cabinet and the housing.

18. The laundry treating machine of claim 14, wherein the one or more damper supporting devices is supported on a top of the housing.

19. The laundry treating machine of claim 1, further comprising:

a plurality of reinforcing ribs that protrudes from a top of the housing to increase a strength of the top of the housing.

20. The laundry treating machine of claim 19, further comprising a plurality of reinforcing ribs that protrudes from sidewalls of the housing.

21. The laundry treating machine of claim 1, wherein the housing comprises a frame having one or more bars coupled to one another to define a space that receives the movable body.

22. The laundry treating machine of claim 1, further comprising:

a front reinforcing member provided to increase a strength of a front cover of the cabinet.

23. The laundry treating machine of claim 1, further comprising:

one or more guide members that guides movement of the movable body.

24. The laundry treating machine of claim 23, wherein the one or more guide members is mounted to an inside surface of the housing.

25. The laundry treating machine of claim 24, wherein the one or more guide members are mounted to an inside surface of sidewalls of the upper base of the housing.

26. The laundry treating machine of claim 24, wherein the one or more guide members are mounted to an inside surface of a lower base of the housing.

27. The laundry treating machine of claim 23, further comprising:

one or more housing reinforcing members mounted inside the housing to increase a strength of the housing and, at the same time, allow the one or more guide members to be mounted thereto.

28. The laundry treating machine of claim 1, further comprising:

a fixing device inserted through a rear wall of the cabinet to fix a rear wall of the housing to the cabinet.

29. The laundry treating machine of claim 28, wherein the fixing device comprises:

a bolt inserted through the rear wall of the cabinet such that the bolt is coupled to the rear wall of the housing; and an elastic member disposed between an outer circumference of the bolt and the cabinet.

30. The laundry treating machine of claim 29, further comprising a boss formed in the rear wall of the housing.

31. The laundry treating machine of claim 1, wherein the movable body is shaped to have a two-step structure such that an upper surface of a left side portion and a right side portion have different heights.

* * * * *